US007090728B2

(12) United States Patent
Nakamura

(10) Patent No.: US 7,090,728 B2
(45) Date of Patent: Aug. 15, 2006

(54) FILM FORMING APPARATUS, HEAD CLEANING METHOD, DEVICE MANUFACTURING SYSTEM, AND DEVICE

(75) Inventor: Shinichi Nakamura, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 415 days.

(21) Appl. No.: 10/383,565

(22) Filed: Mar. 10, 2003

(65) Prior Publication Data

US 2003/0197754 A1 Oct. 23, 2003

(30) Foreign Application Priority Data

Mar. 15, 2002 (JP) ..... 2002-073064

(51) Int. Cl.
*B08B 7/00* (2006.01)

(52) U.S. Cl. ..... 134/6; 134/40; 134/42; 347/33

(58) Field of Classification Search ..... 134/6, 134/40, 42; 347/33
See application file for complete search history.

(56) References Cited

U.S. PATENT DOCUMENTS

| | | | | |
|---|---|---|---|---|
| 5,793,390 | A * | 8/1998 | Claflin et al. | 347/33 |
| 5,963,229 | A * | 10/1999 | Fukuoka | 347/33 |
| 6,460,967 | B1 * | 10/2002 | Makita et al. | 347/33 |
| 6,464,326 | B1 * | 10/2002 | Weeks | 347/33 |
| 6,517,187 | B1 * | 2/2003 | Dietl et al. | 347/33 |
| 2002/0109744 | A1 * | 8/2002 | Shindo | 347/23 |
| 2003/0007049 | A1 * | 1/2003 | Hino | 347/92 |
| 2003/0081054 | A1 * | 5/2003 | Nakagawa et al. | 347/33 |
| 2003/0197754 | A1 * | 10/2003 | Nakamura | 347/33 |

FOREIGN PATENT DOCUMENTS

| | | |
|---|---|---|
| EP | 1 074 861 A2 | 2/2001 |
| JP | 06-155754 | 6/1994 |
| JP | A 2000-103086 | 4/2000 |
| JP | A 2000-177153 | 6/2000 |
| JP | A 2001-150690 | 6/2001 |
| KR | P2002-0009010 | 2/2002 |

* cited by examiner

*Primary Examiner*—Sharidan Carrillo
(74) *Attorney, Agent, or Firm*—Oliff & Berridge, PLC

(57) ABSTRACT

A system and method for reliably cleaning the nozzle face of each head while flexibly coping with changes in specification for a product to be manufactured. The film forming apparatus has a plurality of heads for jetting droplets, each having an nozzle in a nozzle face; and a common head cleaning mechanism for collectively cleaning the nozzle faces, so that the head cleaning mechanism is not substantially affected by a change in the pitch between the heads, or the like. Typically, the head cleaning mechanism has a wiping sheet for wiping the nozzle faces; a supply unit for feeding the wiping sheet towards the nozzle faces; and a roller for pressing the wiping sheet against the nozzle faces while the wiping sheet is fed from the supply unit, so that an unused cleaning face can always be supplied to each nozzle face.

6 Claims, 18 Drawing Sheets

FILM FORMING APPARATUS, HEAD CLEANING METHOD, DEVICE MANUFACTURING SYSTEM, AND DEVICE

BACKGROUND OF THE INVENTION

1. Field of the Invention

The present invention relates to a film forming apparatus having a plurality of heads, a head cleaning method for cleaning each head, a device manufacturing system for manufacturing a device, and a device manufactured by using the film forming apparatus or by a manufacturing process which includes the head cleaning method. In particular, the present invention relates to a film forming apparatus, a head cleaning method, and a device manufacturing system for reliably cleaning each nozzle face while flexibly coping with changes in specification for a substrate to be manufactured, and relates to devices manufactured using the film forming apparatus, the head cleaning method, and the device manufacturing system.

2. Description of the Related Art

According to recent improvements in various kinds of electronic devices such as computers, portable information devices, and the like, demand and applicable fields for liquid crystal devices, in particular, color liquid crystal devices, have increased. Such liquid crystal devices use a color filter substrate for colorizing the display image. In order to manufacture the color filter substrate, an inkjet method is known, in which color filter elements R (red), G (green), and B (blue) are formed as a specific pattern on the substrate.

In order to implement the inkjet method, an inkjet system having a plurality of inkjet heads for jetting ink droplets has been developed. Each inkjet head has an ink chamber for temporarily storing ink which is supplied from an external device, a pressure generating element (e.g., piezo element) functioning as a driving force for jetting a specific amount of ink stored in the ink chamber, and a nozzle face having an opening (i.e., nozzle) through which each ink droplet is jetted from the ink chamber.

The inkjet heads are arranged at an equivalent pitch so as to form a set of heads, and ink droplets are jetted while the substrate is scanned by the set of heads which is moved in a specific direction (e.g., the X direction), so that R, G, and B inks are supplied to the substrate. On the other hand, the position of the substrate in the Y direction, which is perpendicular to the X direction, is controlled at the side of a stage on which the substrate is placed.

Regarding the substrate to be manufactured (e.g., the color filter substrate), high resolution is required and thus finer patterns should be formed. In consideration of these circumstances, it is necessary for each inkjet head to very accurately supply each ink droplet (of R, G, or B) on a specific area. Therefore, each inkjet head should straightly jet a specific size of ink droplet towards a target point on the substrate. However, if ink remains on the nozzle face, the remaining ink may obstruct desired jetting of ink droplets. Such remaining ink is produced when a portion of an ink droplet adheres to the nozzle face, and it is difficult to completely prevent the occurrence of remaining ink when ink is used.

In order to solve this problem, a cleaning mechanism for wiping remaining ink which is adhered on the nozzle face may be provided for each inkjet head. However, this method causes another problem; that is, it is difficult to flexibly cope with diversified specifications for the substrate, where diversification of the substrate has been accelerated.

That is, when the size of the substrate (e.g., color filter substrate) to be manufactured, the pitch for pixels, or the like is changed in the specification, in the set of the heads, the arrangement pitch between the inkjet heads or the degree of inclination of each inkjet head with respect to the scanning direction can be changed; however, it may also be required to adjust the position of the cleaning mechanism for each inkjet head or to replace all the cleaning mechanisms. Such adjustment imposes a great burden on the worker or operator, and in addition to that, improvement of productivity may be obstructed.

SUMMARY OF THE INVENTION

In consideration of the above circumstances, an object of the present invention is to provide a system and method for reliably cleaning the nozzle face of each head while flexibly coping with changes in specification for a substrate to be manufactured, or the like.

The present invention provides a film forming apparatus comprising:

a plurality of heads for jetting droplets, each head having an nozzle in a nozzle face; and a head cleaning mechanism for collectively cleaning the nozzle faces of the heads.

When the specification (e.g., size) of a substrate or the like to be manufactured is changed, the measurements such as the pitch between the heads should be changed. In such a situation, if a structure having a dedicated head cleaning mechanism for each head is employed so as to clean the nozzle face of the head, the arrangement of the head cleaning mechanisms should also be changed in accordance with a change in the pitch between the heads, and the like. However, the head cleaning mechanism of the present invention has a structure for collectively cleaning the nozzle faces using a common head cleaning mechanism; therefore, the head cleaning mechanism is not substantially affected by such a change in the pitch between the heads, or the like.

The head cleaning mechanism may comprise:

a wiping sheet for wiping the nozzle faces;

a wiping sheet supply unit for feeding the wiping sheet towards the nozzle faces; and a roller for pressing the wiping sheet against the nozzle faces while the wiping sheet is fed from the wiping sheet supply unit.

Accordingly, the wiping sheet is pressed against each nozzle face by using the roller while the wiping sheet is fed towards the nozzle faces, so that an unused cleaning face can always be supplied to each nozzle face. In addition, in the structure, the wiping sheet is pressed against the nozzle faces by the pressing force using the roller; thus, the wiping face of the wiping sheet can be reliably applied to each nozzle face.

Preferably, widths of the wiping sheet and the roller are each equal to or greater than a total width of the nozzle faces, where the total width is measured in the direction parallel to the widths of the wiping sheet and the roller. Accordingly, all nozzle faces are present within the area of the cleaning face of the wiping sheet; thus, all nozzle faces can be reliably wiped.

The head cleaning mechanism may further comprise a cleaning liquid supply unit for jetting cleaning liquid towards the wiping sheet. If a dried wiping sheet is pressed against the nozzle faces (i.e., in the dry wiping system), ink or the like in each head may be excessively attracted towards the nozzle face due to the absorbency of the wiping sheet. However, in the present invention in which the cleaning face of the wiping sheet is moistened in advance by using the cleaning liquid supplied from the cleaning liquid supply unit (i.e., in the wet wiping system), it is possible to prevent an excessive amount of liquid (e.g., ink) from being drawn from the head and to reliably remove the remaining liquid adhered to each nozzle face.

Typically, the pushing force of the wiping sheet onto the nozzle faces is set to a predetermined pushing force. Accordingly, the nozzle faces are wiped by the wiping sheet with a suitably-controlled (or maintained) pushing force; thus, it is possible to prevent the nozzle faces from being damaged by pushing the wiping sheet with an excessive force, or prevent the ink or the like adhered to the nozzle faces from being incompletely removed from the nozzle face by pushing the wiping sheet with insufficient force.

Preferably, the predetermined pushing force is from 100 to 1000 gf.

If the predetermined pushing force is lower than 100 gf, the ink or the like adhered to the nozzle faces may not be completely removed due to insufficient pushing force. On the other hand, if the predetermined pushing force is higher than 1000 gf, the nozzle faces may be damaged by the excessive force. Therefore, the predetermined pushing force is defined to be from 100 to 1000 gf, so that damage to the nozzle faces and remaining of ink or the like adhering to each nozzle face can be reliably prevented.

It is possible that:

the roller and the wiping sheet deform when the roller is pushed via the wiping sheet onto the nozzle faces; and the predetermined pushing force is set by adjusting the amount of deformation of the wiping sheet and the roller to a predetermined amount.

Accordingly, the pushing force of the wiping sheet can be easily set to be within the predetermined range without directly measuring the pushing force applied to each nozzle face.

Preferably, the predetermined amount of deformation is from 0.1 to 1 mm.

Accordingly, if the predetermined amount is less than 0.1 mm, it can be determined that the pushing force via the wiping sheet is insufficient, and conversely, if the predetermined amount exceeds 1 mm, it can be determined that the pushing force via the wiping sheet is excessive. Therefore, the predetermined amount of deformation is set within the range from 0.1 to 1 mm, so that the pushing force via the wiping sheet can be easily set to be in a predetermined range.

The present invention also provides a head cleaning method for cleaning a plurality of heads for jetting droplets, each head having an nozzle in a nozzle face, the method comprising the step of:

collectively cleaning the nozzle faces of the heads by using a common head cleaning mechanism.

When the specification (e.g., size) of a substrate or the like to be manufactured is changed, the measurements such as the pitch between the heads should be changed. In such a situation, if a structure having a dedicated head cleaning mechanism for each head is employed so as to clean the nozzle face of the head, the arrangement of the head cleaning mechanisms should also be changed in accordance with a change in the pitch between the heads, and the like. However, the present invention employs a method of collectively cleaning the nozzle faces using a common head cleaning mechanism; therefore, the process based on the method is not substantially affected by such a change in the pitch between the heads, or the like.

Typically, the head cleaning mechanism has a wiping sheet and a roller: and the step of collectively cleaning the heads includes wiping the nozzle faces by pushing the roller via the wiping sheet onto the nozzle faces while the wiping sheet is fed towards the nozzle faces.

Accordingly, the wiping sheet is pressed against each nozzle face by using the roller while the wiping sheet is fed towards the nozzle faces, so that an unused cleaning face can always be supplied to each nozzle face. In addition, in the method, the wiping sheet is pressed against the nozzle faces by the pressing force using the roller; thus, the wiping face of the wiping sheet can be reliably applied to each nozzle face.

The step of collectively cleaning the heads may include supplying a cleaning liquid to the wiping sheet so as to moisten the wiping sheet before wiping the nozzle faces.

If a dried wiping sheet is pressed against the nozzle faces (i.e., in the dry wiping system), ink or the like in each head may be excessively attracted towards the nozzle face due to the absorbency of the wiping sheet. However, in the present invention in which the cleaning face of the wiping sheet is moistened in advance by using the cleaning liquid supplied from the cleaning liquid supply unit (i.e., in the wet wiping system), it is possible to prevent an excessive amount of liquid (e.g., ink) from being drawn from the head and to reliably remove the remaining liquid adhered to each nozzle face.

Typically, in the head cleaning method, the pushing force of the roller via the wiping sheet onto the nozzle faces is maintained to be a predetermined pushing force. Accordingly, the nozzle faces are wiped by the wiping sheet with a suitably-controlled (or maintained) pushing force; thus, it is possible to prevent the nozzle faces from being damaged by pushing the wiping sheet with an excessive force, or prevent the ink or the like adhered to the nozzle faces from being incompletely removed from the nozzle face by pushing the wiping sheet with insufficient force.

Preferably, the predetermined pushing force is from 100 to 1000 gf.

As explained above, if the predetermined pushing force is lower than 100 gf, the ink or the like adhered to the nozzle faces may not be completely removed due to insufficient pushing force. On the other hand, if the predetermined pushing force is higher than 1000 gf, the nozzle faces may be damaged by the excessive force. Therefore, the predetermined pushing force is defined to be from 100 to 1000 gf, so that damage to the nozzle faces and remaining of ink or the like adhering to each nozzle face can be reliably prevented.

It is possible that:

the roller and the wiping sheet deform when the roller is pushed via the wiping sheet onto the nozzle faces; and the method further comprises setting the predetermined pushing force by adjusting the amount of deformation of the wiping sheet and the roller to a predetermined amount.

Accordingly, the pushing force of the wiping sheet can be easily set to be within the predetermined range without directly measuring the pushing force applied to each nozzle face.

Preferably, the predetermined amount of deformation is from 0.1 to 1 mm.

As explained above, if the predetermined amount is less than 0.1 mm, it can be determined that the pushing force via the wiping sheet is insufficient, and conversely, if the predetermined amount exceeds 1 mm, it can be determined that the pushing force via the wiping sheet is excessive. Therefore, the predetermined amount of deformation is set within the range from 0.1 to 1 mm, so that the pushing force via the wiping sheet can be easily set to be in a predetermined range.

Typically, in the above-explained film forming apparatus or the head cleaning method, the heads are inkjet heads for jetting ink droplets.

The present invention also provides a device manufacturing system which includes a film forming apparatus as explained above. Accordingly, it is possible by the film forming apparatus to flexibly cope with changes in specification for the products to be manufactured (e.g., specification for substrates) and thus to manufacture devices corresponding to various kinds of specifications.

The present invention also provides a device which is manufactured using the above device manufacturing system. Accordingly, it is possible by the film forming apparatus to flexibly cope with changes in specification for the products to be manufactured and thus to obtain devices corresponding to various kinds of specifications.

The present invention also provides a device manufacturing system in which a head cleaning method as explained above is performed in a head cleaning process. Accordingly, it is possible by the head cleaning method to flexibly cope with changes in specification for the products to be manufactured and thus to obtain devices corresponding to various kinds of specifications.

Therefore, according to the present invention, the nozzle faces can be reliably cleaned while flexibly coping with changes in specification for the products.

BRIEF DESCRIPTION OF THE DRAWINGS

FIG. 3A is a perspective view showing a stripe pattern, FIG. 3B is a partially-enlarged view showing a mosaic pattern, and FIG. 3C is a partially-enlarged view showing a delta pattern.

FIG. 11A is a diagram viewed from the side opposite to the nozzle face, and FIG. 11B is a sectional view along line D—D in FIG. 11A.

FIG. 12A is a diagram for explaining the scanning direction, and FIG. 12B is a diagram for explaining a change in the pitch between the nozzles.

FIG. 18A shows the state before the wiping sheet is pressed against the nozzle face, and FIG. 18B shows the state in which the wiping sheet is pressed against the nozzle face.

DESCRIPTION OF THE PREFERRED EMBODIMENTS

Figure 1:
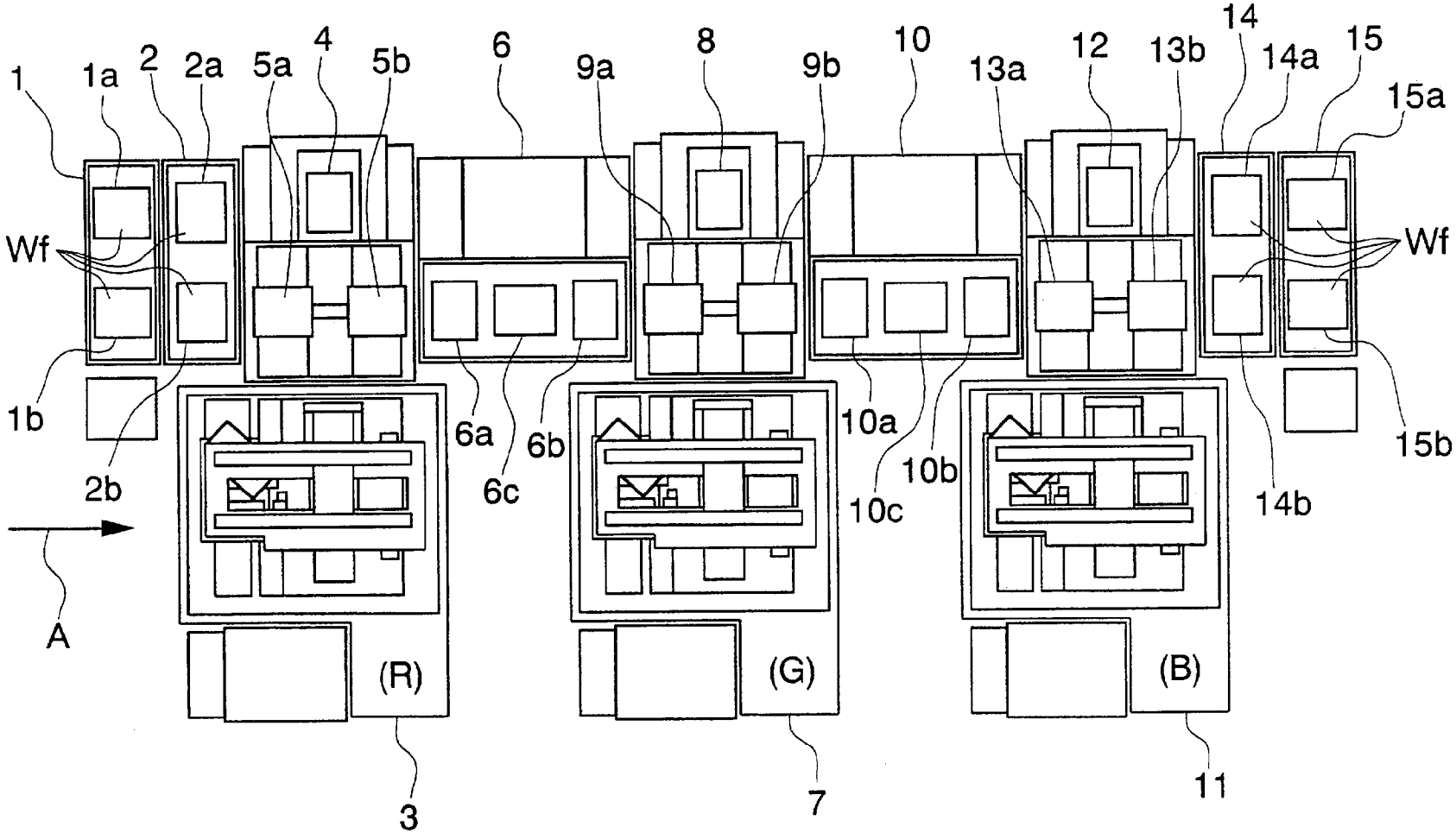
FIG. 1 shows an embodiment of the device manufacturing system comprising an inkjet device according to the present invention and is a plan view showing the arrangement of each structural element in the device manufacturing system.

Hereinafter, an embodiment according to the present invention will be explained with reference to the drawings. However, of course, the present invention is not limited to the explained embodiment.

In the following explanations, first, a device manufacturing system and an example of the device in the present embodiment will be explained with reference to FIGS. 1 to 4, and next, the film forming apparatus provided in the device manufacturing system and the head cleaning method will be explained with reference to FIGS. 5 to 18.

Device Manufacturing System and Related Device

First, the device manufacturing system of the present embodiment will be explained with reference to FIG. 1, which is a plan view showing the arrangement of each structural element.

As shown in the figure, the device manufacturing system of the present embodiment comprises (i) a wafer supply unit 1 for storing substrates to be processed (i.e., glass substrates which are called wafers Wf hereinbelow), (ii) a wafer rotating unit 2 for determining the ink drawing direction on each wafer Wf transferred from the wafer supply unit 1, (iii) an inkjet device 3 functioning as a film forming apparatus for producing R (red) filter elements on the wafer Wf which is transferred from the wafer rotating unit 2, (iv) a baking furnace 4 for drying the wafer Wf transferred from the inkjet device 3, (v) robots 5*a* and 5*b* for performing transfer of the wafer Wf between the relevant units (which will be explained below), (vi) an intermediate transfer unit 6 for cooling the wafer Wf transferred from the baking furnace 4 before the wafer Wf is transferred to the next unit, and for determining the ink drawing direction, (vii) an inkjet device 7 functioning as a film forming apparatus for producing G (green) filter elements on the wafer Wf which is transferred from the intermediate transfer unit 6, (viii) a baking furnace 8 for drying the wafer Wf transferred from the inkjet device 7, (ix) robots 9*a* and 9*b* for performing transfer of the wafer Wf between the relevant units (which will be explained below), (x) an intermediate transfer unit 10 for cooling the wafer Wf transferred from the baking furnace 8 before the wafer Wf is transferred to the next unit, and for determining the ink drawing direction, (xi) an inkjet device 11 functioning as a film forming apparatus for producing B (blue) filter elements on the wafer Wf which is transferred from the intermediate transfer unit 10, (xii) a baking furnace 12 for drying the wafer Wf transferred from the inkjet device 11, (xiii) robots 13*a* and 13*b* for performing transfer of the wafer Wf between the relevant units (which will be explained below), (xiv) a wafer rotating unit 14 for determining the storage direction of the wafer Wf transferred from the baking furnace 12, and (xv) a wafer storage 15 for storing the wafer Wf transferred from the wafer rotating unit.

The wafer supply unit 1 includes two magazine loaders 1*a* and 1*b*, each having an elevating mechanism for storing, for example, 20 wafers Wf in the vertical direction; thus, the wafers Wf can be supplied in turn.

The wafer rotating unit 2 determines the drawing direction for ink drawing using the inkjet device 3 on the wafer Wf and also temporarily positions the wafer Wf before the wafer is transferred to the inkjet device 3. The wafer rotating unit 2 includes two wafer rotating stages 2*a* and 2*b*, each for precisely storing wafers Wf at a pitch of 90 degrees around the vertical axis of the stage and in a rotatable form.

Explanations of the inkjet devices 3, 7, and 11 are omitted here but will be explained below in detail.

The baking furnace 4 is provided for drying the red ink on the wafer Wf which is transferred from the inkjet device 3, by placing the wafer Wf in a high-temperature environment, for example, of up to 120° C. for 5 minutes. The drying process solves some problems; for example, it is possible to prevent the red ink from being dispersed during the transfer of the wafer Wf.

Each of the robots 5*a* and 5*b* has an arm (not shown) which can extend from a base and can rotate around the base. A vacuum attracting pad is attached to the end of the arm, and the transfer operation of the wafer Wf between the relevant units can be smoothly and efficiently performed by attracting the wafer Wf by using the vacuum attracting pad.

The intermediate transfer unit 6 has a cooler 6*a* for cooling the heated wafer Wf (which is transferred from the baking furnace 4 by using the robot 5*b*) before transferring the wafer to the next unit; a wafer rotating stage 6*b* for determining the drawing direction for ink drawing using the inkjet device 7 on the wafer Wf which has been cooled, and for temporarily positioning the wafer Wf before the wafer is transferred to the inkjet device 7; and a buffer 6*c* for canceling a difference between the operation speeds of the inkjet devices 3 and 7. Here, the wafer rotating stage 6*b* can rotate the wafer Wf around the vertical axis of the unit at a rotation pitch of 90 degrees or 180 degrees.

The inkjet device 3 for producing red filter elements and the inkjet device 7 for producing green filter elements have different times necessary for the drying and also have different times necessary for cleaning the inkjet head (which will be explained below), thereby producing a difference between the operation speeds of the inkjet devices 3 and 7. The buffer 6*c* is provided for canceling this difference, and a plurality of wafers Wf can be temporarily stored in a stock stage (having a structure similar to an elevator) of the buffer 6*c*.

The baking furnace 8 is a heating furnace having a structure similar to that of the baking furnace 4, that is, the baking furnace 8 is provided for drying the green ink on the wafer Wf which is transferred from the inkjet device 7, by placing the wafer Wf in a high-temperature environment, for example, of up to 120° C. for 5 minutes, and the drying process solves similar problems; for example, it is possible to prevent the green ink from being dispersed during the transfer of the wafer Wf.

The robots 9*a* and 9*b* have structures similar to those of the robots 5*a* and 5*b*, that is, each of the robots 9*a* and 9*b* has an arm (not shown) which can extend from a base and can rotate around the base. A vacuum attracting pad is attached to the end of the arm, and the transfer operation of the wafer Wf between the relevant units can be smoothly and efficiently performed by attracting the wafer Wf by using the vacuum attracting pad.

The intermediate transfer unit 10 has a structure similar to that of the intermediate transfer unit 6, that is, the intermediate transfer unit 10 has a cooler 10*a* for cooling the heated wafer Wf (which is transferred from the baking furnace 8 by using the robot 9*b*) before transferring the wafer to the next unit; a wafer rotating stage 10*b* for determining the drawing direction for ink drawing using the inkjet device 11 on the wafer Wf which has been cooled, and for temporarily positioning the wafer Wf before the wafer is transferred to the inkjet device 11; and a buffer 10*c* for canceling a difference between the operation speeds of the inkjet devices 7 and 11. Here, the wafer rotating stage 10*b* can rotate the wafer Wf around the vertical axis of the unit at a rotation pitch of 90 degrees or 180 degrees.

The baking furnace 12 is a heating furnace having a structure similar to that of the baking furnace 4 or 8, that is, the baking furnace 12 is provided for drying the blue ink on the wafer Wf which is transferred from the inkjet device 11, by placing the wafer Wf in a high-temperature environment, for example, of up to 120° C. for 5 minutes, and the drying process solves similar problems; for example, it is possible to prevent the blue ink from being dispersed during the transfer of the wafer Wf.

The robots 13*a* and 13*b* have structures similar to those of the robots 5*a* and 5*b* (or 9*a* and 9*b*), that is, each of the robots 13*a* and 13*b* has an arm (not shown) which can extend from a base and can rotate around the base. A vacuum attracting pad is attached to the end of the arm, and the transfer operation of the wafer Wf between the relevant units can be smoothly and efficiently performed by attracting the wafer Wf by using the vacuum attracting pad.

The wafer rotating unit 14 can rotate each wafer Wf in a manner such that the wafer Wf is positioned in a specific direction, where a specific pattern consisting of the R, G, and B filter elements has been formed on the wafer Wf by using the inkjet devices 3, 7, and 11. More specifically, the wafer rotating unit 14 has two wafer rotating stages 14*a* and 14*b*, each for precisely storing wafers Wf at a pitch of 90 degrees around the vertical axis of the stage and in a rotatable form.

The wafer storage 15 includes two magazine unloaders 15*a* and 15*b*, each having an elevating mechanism for storing, for example, 20 wafers Wf in the vertical direction, which are transferred from the wafer rotating unit 14 and are thus color filter substrates as complete products; therefore, the wafers Wf can be stored in turn.

Below, a series of processes for manufacturing color filter substrates by using the device manufacturing system of the present embodiment will be explained with reference to FIGS. 1 to 3C, where the processes include an RGB pattern forming process.

FIGS. 2A to 2F are diagrams for explaining a series of processes for manufacturing color filter substrates, where the processes indicated by FIGS. 2A to 2F are executed in this order.

Figure 3A:
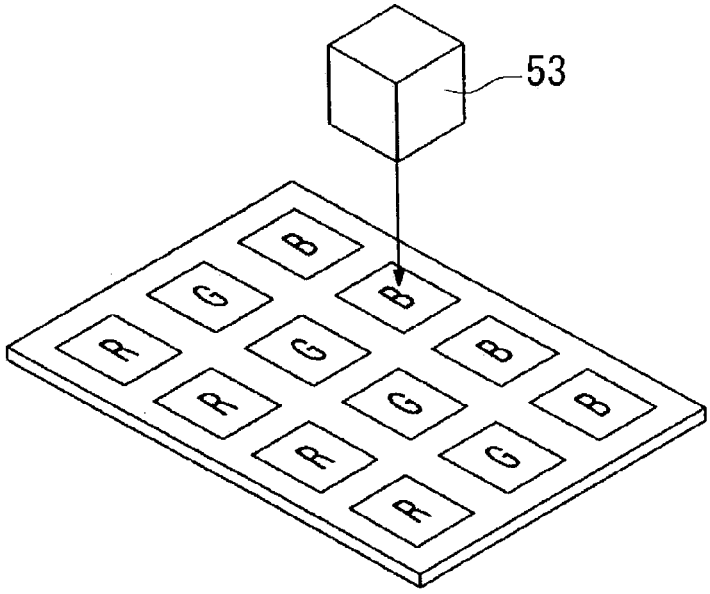
FIGS. 3A to 3C are diagrams showing examples of the RGB pattern formed using the inkjet devices of the device manufacturing system, where
Figure 3B:
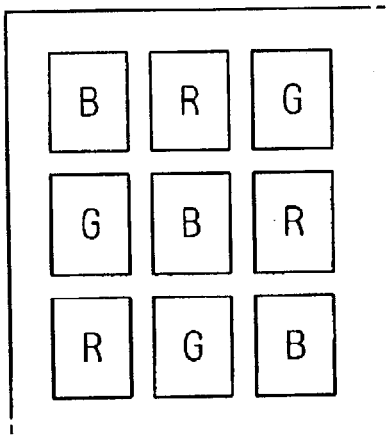
Figure 3C:
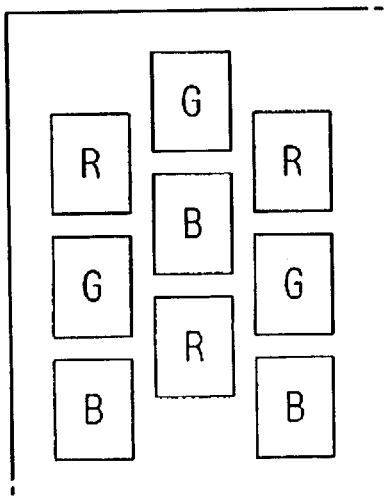

FIGS. 3A to 3C are diagrams showing examples of the RGB pattern formed using the inkjet devices of the device manufacturing system. FIG. 3A is a perspective view showing a wafer on which a stripe pattern is formed, FIG. 3B is a partially-enlarged view showing a mosaic pattern, and FIG. 3C is a partially-enlarged view showing a delta pattern.

Typically, each wafer Wf used in the manufacturing is a transparent substrate having a rectangular and thin plate shape and has a suitable mechanical strength and a high optical transmittance. Preferably, the wafer Wf is a transparent glass substrate, an acrylic glass, a plastic substrate, a plastic film, or a surface-treated product of one of the preceding objects.

In order to improve the productivity, a plurality of color filter areas are formed in a matrix form before the RGB pattern formation process is performed. After the RGB pattern formation process is performed, the color filter areas are divided by cutting the wafer Wf, thereby producing color filter substrates suitable for liquid crystal devices.

As shown in FIGS. 3A to 3C, in each color filter area, a specific pattern consisting of R (red) filter elements, G (green) filter elements, and B (blue) filter elements is formed using each inkjet head 53 (explained below). The pattern may be a stripe pattern (see FIG. 3A), a mosaic pattern (see FIG. 3B) or a delta pattern (see FIG. 3C), and no limiting condition is assigned to the pattern in the present invention.

In the black matrix forming process (i.e., the process prior to the RGB pattern forming process), one of the faces of a transparent wafer Wf, that is, a base face for color filter substrates, is coated with a resin having no optical transmitting capability (preferably, a black-colored resin) at a specific thickness (e.g., approximately 2 μm) by spin coating or the like. After the above coating, a black matrix grating (see reference symbols "b" in FIG. 2A) is formed using photolithography or the like. Each window in the black matrix grating functions as a smallest display element, that is, so-called filter element (see reference symbols "e"). For example, the window has a width in the X-axis direction of approximately 30 μm and a length in the Y-axis direction of approximately 100 μm. The wafer Wf, on which the black matrix grating "b" has been formed, is heated by a heater (not shown) so as to cure the resin.

Each wafer Wf, on which the black matrix grating "b" has been formed, is then contained in the magazine loader 1*a* or 1*b* of the wafer supply unit 1 shown in FIG. 1, and the RGB pattern forming process is next performed.

First, the wafer Wf, contained in one of the magazine loaders 1*a* and 1*b*, is attracted and held by the arm of the robot 5*a* and is then placed on one of the wafer rotating stages 2*a* and 2*b*. Each of the wafer rotating stages 2*a* and 2*b* performs determination of the drawing direction and positioning of the wafer as a process prior to the supply of red ink droplets.

Figure 2A:
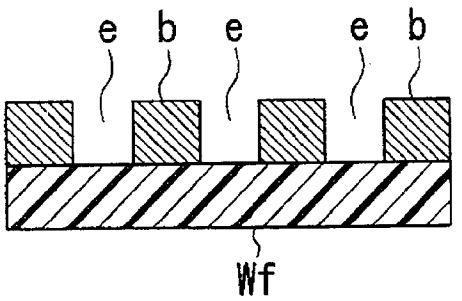
FIGS. 2A to 2F are diagrams for explaining a series of processes for manufacturing color filter substrates, where the processes include the RGB pattern forming process performed by the device manufacturing system and the processes indicated by FIGS. 2A to 2F are executed in this order.
Figure 2B:
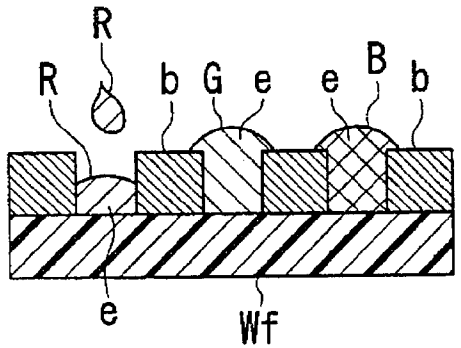
Figure 2C:
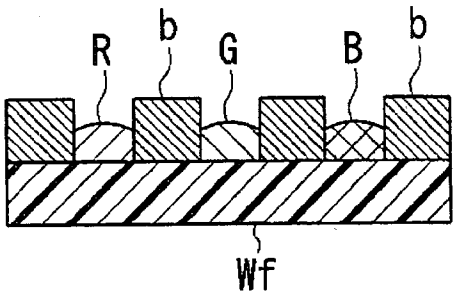

In the next step, the robot 5*a* attracts each wafer Wf on the wafer rotating stages 2*a* and 2*b* and transfers the wafer to the inkjet device 3. As shown in FIG. 2B, red ink droplets (see reference symbol R) are supplied by the inkjet device 3 to a specific set of filter elements "e", which is defined so as to form a specific pattern (FIG. 2B shows an operation in which an ink droplet is supplied when the volume of red ink R is reduced, as explained below). Generally, the amount of each ink droplet is sufficient in consideration of the amount of reduction in volume of ink R during the heating process. The supply of ink droplets R using the inkjet device 3 will be explained in detail below.

After the predetermined set of filter elements for red ink R are filled with red ink R, the wafer Wf is subjected to a drying process at a specific temperature (e.g., approximately 70° C.). In this process, when solvent for ink R is evaporated, the volume of ink R is reduced (refer to FIG. 2C). If the degree of volume reduction is pronounced, the supply of ink droplet R and the proceeding drying process are repeated until a thickness sufficient to form a color filter substrate is obtained. Accordingly, the solvent in ink R is evaporated and finally, only the solid component of ink R remains, which forms a film.

The drying step in the process of forming the red pattern is performed using the baking furnace 4 in FIG. 1. The wafer Wf after the drying step is in a heated state; thus, it is transferred to the cooler 6*a* by the robot 5*b*, so as to cool the wafer. The wafer Wf, after cooling, is temporarily stored in the buffer 6*c* so as to control the working time, and is then transferred to the wafer rotating stage 6*b*, where the ink drawing direction and the position of the wafer are determined in advance before the supply of green ink.

After the robot 9*a* attracts the wafer Wf on the wafer rotating stage 6*b*, the wafer is transferred to the inkjet device 7.

As shown in FIG. 2B, green ink droplets (see reference symbol G) are supplied by the inkjet device 7 to a specific set of filter elements "e", which is defined so as to form a specific pattern. Generally, the amount of each ink droplet is sufficient in consideration of the amount of reduction in volume of ink G during the heating process.

After the predetermined set of filter elements for green ink G are filled with green ink G, the wafer Wf is subjected to a drying process at a specific temperature (e.g., approximately 70° C.). In this process, when solvent for ink G is evaporated, the volume of ink G is reduced (refer to FIG. 2C). If the degree of volume reduction is pronounced, the supply of ink droplet G and the proceeding drying process are repeated until a thickness sufficient to form a color filter substrate is obtained. Accordingly, the solvent in ink G is evaporated and finally, only the solid component of ink G remains, which forms a film.

The drying step in the process of forming the green pattern is performed using the baking furnace 8 in FIG. 1. The wafer Wf after the drying step is in a heated state; thus, it is transferred to the cooler 10*a* by the robot 9*b*, so as to cool the wafer. The wafer Wf, after cooling, is temporarily stored in the buffer 10*c* so as to control the working time, and is then transferred to the wafer rotating stage 10*b*, where the ink drawing direction and the position of the wafer are determined in advance before the supply of blue ink.

After the robot 13*a* attracts the wafer Wf on the wafer rotating stage 10*b*, the wafer is transferred to the inkjet device 11.

As shown in FIG. 2B, blue ink droplets (see reference symbol B) are supplied by the inkjet device 11 to a specific set of filter elements "e", which is defined so as to form a specific pattern. Generally, the amount of each ink droplet is sufficient in consideration of the amount of reduction in volume of ink B during the heating process. The supply of ink droplets B using the inkjet device 11 will be explained in detail below.

After the predetermined set of filter elements for blue ink B are filled with blue ink B, the wafer Wf is subjected to a drying process at a specific temperature (e.g., approximately 70° C.). In this process, when solvent for ink B is evaporated, the volume of ink B is reduced (refer to FIG. 2C). If the degree of volume reduction is pronounced, the supply of ink droplet B and the proceeding drying process are repeated until a thickness sufficient to form a color filter substrate is obtained. Accordingly, the solvent in ink B is evaporated and finally, only the solid component of ink B remains, which forms a film.

The drying step in the process of forming the blue pattern is performed using the baking furnace 12 in FIG. 1. The wafer Wf, after the drying step, is transferred to one of the wafer rotating stages 14*a* and 14*b* by the robot 13*b*, so as to rotate and position the wafer in a specific direction. The wafer Wf after the positioning is contained in one of the magazine unloaders 15*a* and 15*b* by the robot 13*b*.

Figure 2D:
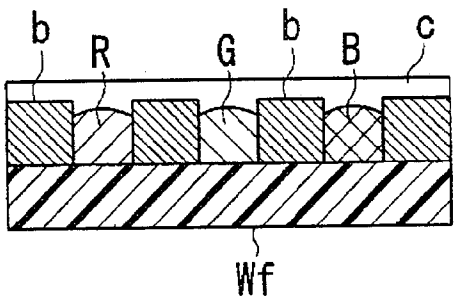
Figure 2E:
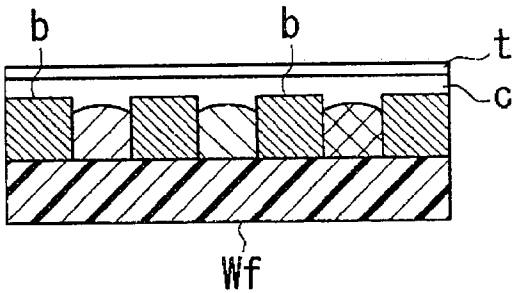
Figure 2F:
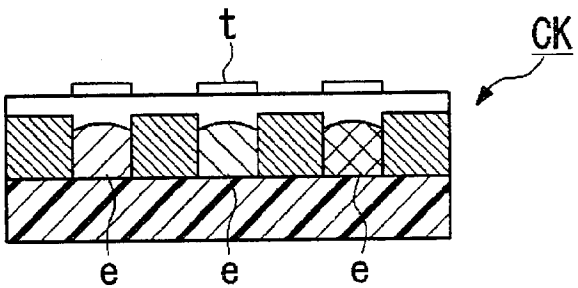

The RGB pattern forming process is here completed and the following processes as shown by FIGS. 2D to 2F will be performed.

In the protection film forming process as shown in FIG. 2D, heating at a specific temperature is performed so as to completely dry each ink R, G, and B. When the drying step is completed, a protection film (see reference symbol "c" in FIG. 2D) is formed so as to protect and smooth the surface of the wafer Wf, on which ink films have been formed. Here, spin coating, roll coating, dipping, or the like may be employed in order to form the protection film c.

In the following transparent electrode forming process as shown in FIG. 2E, sputtering, vacuum evaporation, or the like is performed so as to coat the entire surface of the protection film c with a transparent electrode (see reference symbol "t").

In the next patterning process as shown in FIG. 2F, the transparent electrode t is patterned so as to produce pixel electrodes. However, this patterning is unnecessary if the device to be manufactured employs a liquid crystal which is driven by a TFT (thin film transistor) or the like.

Figure 4:
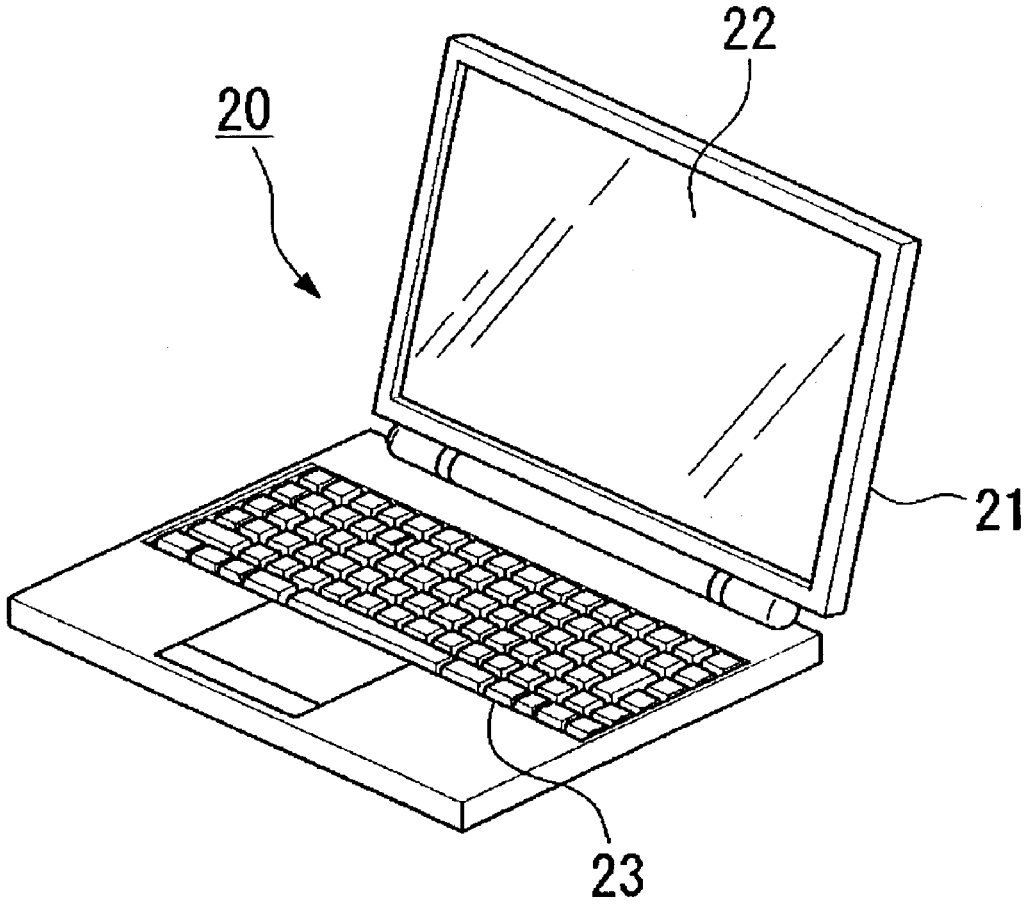
FIG. 4 is a perspective view showing a laptop computer as an example of the device which is manufactured to have a liquid crystal display device manufactured by the device manufacturing system.

According to the above-explained processes, a color film substrate CK as shown in FIG. 2F is produced. If a liquid crystal device is produced by combining the color film substrate CK with another substrate (not shown) in a manner such that the substrates face each other, a laptop computer 20 (i.e., device) as shown in FIG. 4 can be produced. The laptop computer 20 shown in FIG. 4 comprises a body 21, the above-explained liquid crystal device built into the body 21 (refer to reference numeral 22), a keyboard 23 as an input device, and a display signal generator (not shown) including various circuits which include a display data output source, a display data processing unit, a clock generating circuit, and the like, and a power supply circuit for supplying electrical power to the above circuits. Typically, display signals, which are generated by the display signal generator based on data which are input by using the keyboard 23, are supplied to the liquid crystal device 22, thereby producing displayed images.

The device, into which the color filter substrate CK according to the present embodiment is built, is not limited to the laptop computer 20, but may be one of various kinds of electronic devices such as a cellular phone, electronic notebook, pager, POS terminal, IC card, mini disk player, liquid crystal projector, engineering workstation (EWS), word processor, television, video recorder having a view finder or a direct-view monitor, electronic pocket calculator, car navigation system, device employing a touch panel, clock, game device, or the like.

Film Forming Apparatus and Head Cleaning Method

Below, the inkjet devices 3, 7, and 11, which are included in the device manufacturing system and function as film forming apparatuses, will be explained in detail with reference to FIGS. 5 to 18. The inkjet devices 3, 7, and 11 have substantially the same structure; thus, the inkjet device 3 will be explained below and explanations of the other inkjet devices 7 and 11 (having the same structure) are omitted.

Figure 5:
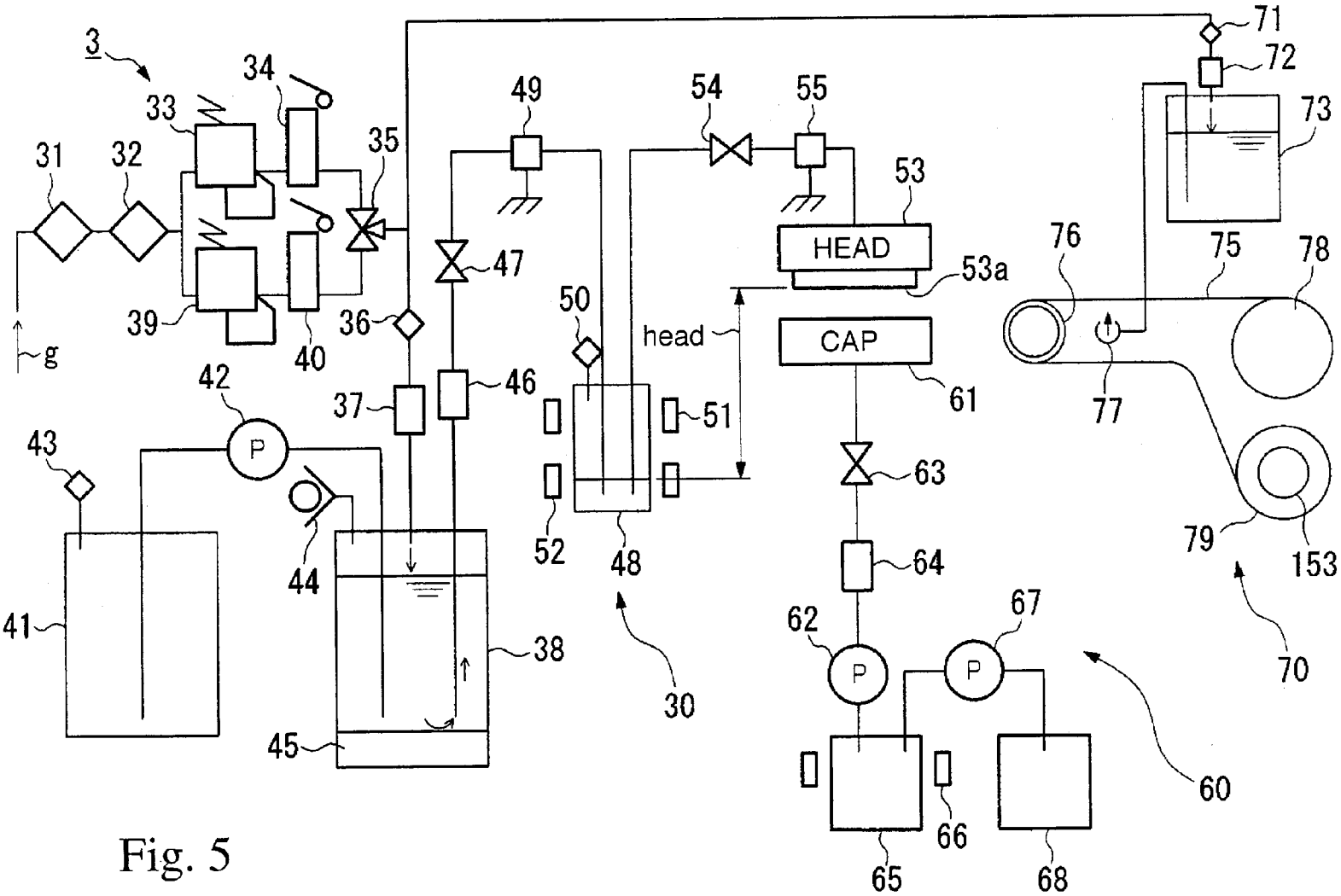
FIG. 5 is a diagram showing the general structure (i.e., main structural elements) of the inkjet device in the device manufacturing system.
Figure 6:
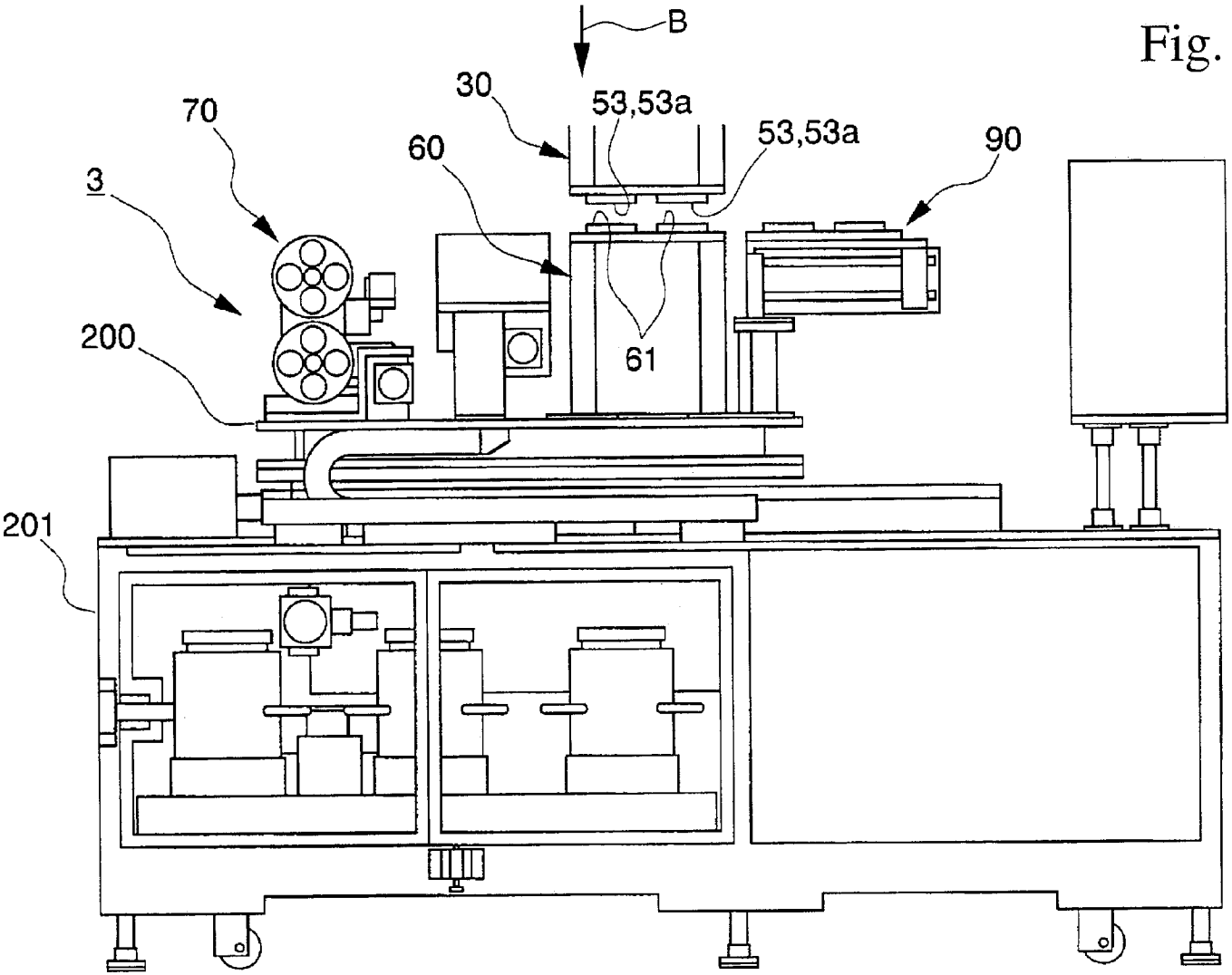
FIG. 6 is a side view showing a portion of the inkjet device, which is viewed along arrow A in FIG. 1.
Figure 7:
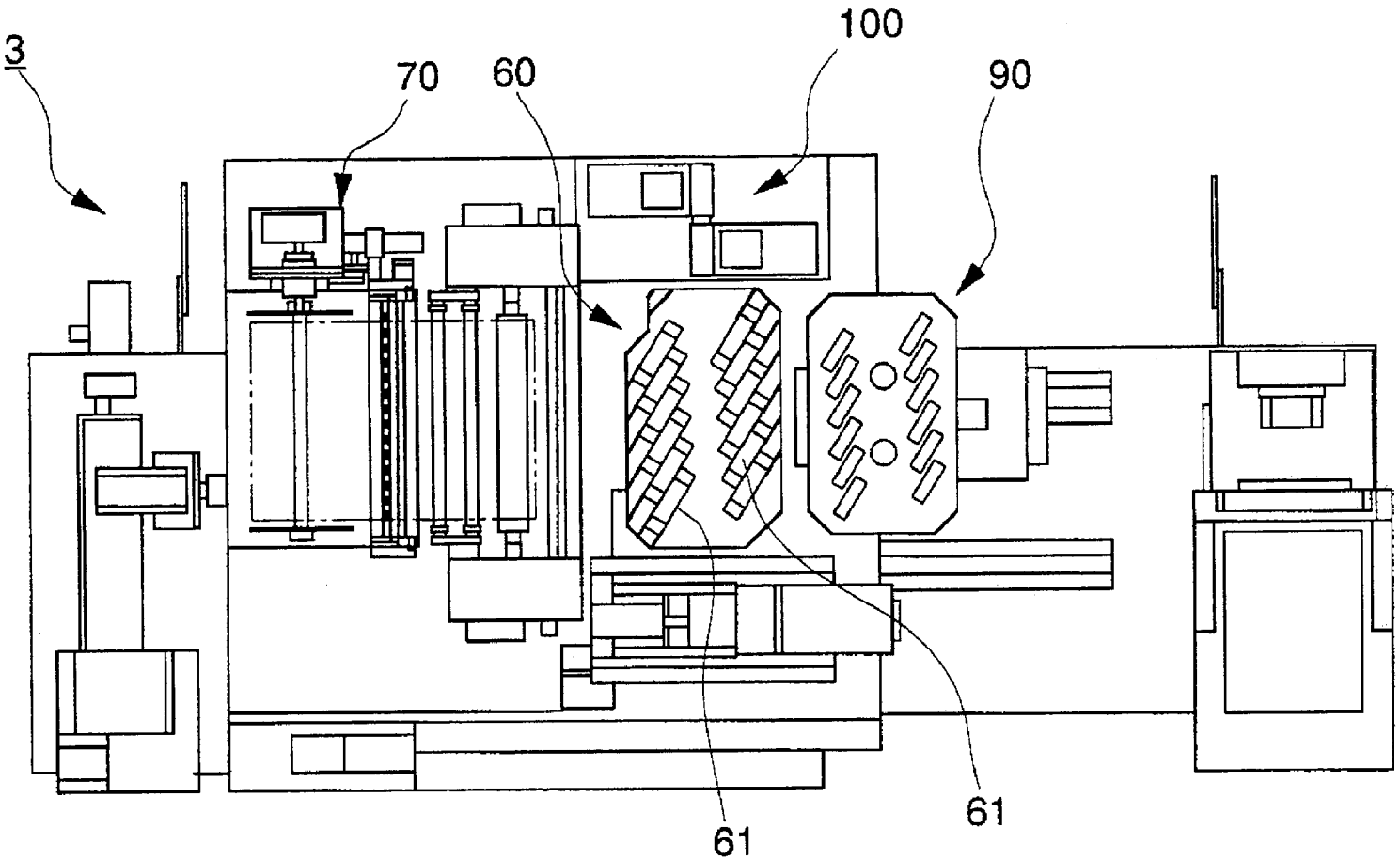
FIG. 7 is a plan view of the inkjet device, which is viewed along arrow B in FIG. 6.

FIG. 5 is a diagram showing the general structure of the inkjet device 3, that is, the main structural elements of the inkjet device 3. FIG. 6 is a side view showing a portion of the inkjet device 3, which is viewed along arrow A in FIG. 1. FIG. 7 is a plan view of the inkjet device 3, which is viewed along arrow B in FIG. 6.

As shown in FIGS. 5 to 7, the main structural elements of the inkjet device 3 of the present embodiment include an inkjet unit 30, a cap unit 60, a wiping unit 70 (corresponding to the head cleaning mechanism of the present invention), a weight measurement unit 90 (not shown in FIG. 5), and a dot drop detection unit 100 (not shown in FIG. 5).

Inkjet Unit 30

The inkjet unit 30 is provided for supplying ink to each inkjet head 53 and jetting ink droplet R towards the wafer Wf. As shown in FIG. 5, in the inkjet unit 30, an inert gas "g" such as nitrogen is supplied to the air filter 31 so as to remove impurities included in the inert gas g. The inert gas g then passes through the mist separator 32, so that mist included in the inert gas g is also removed. After removing the mist, the inert gas G can be drawn into two systems: one system for pumping (and conveying) ink and the other system for pumping (and conveying) cleaning liquid. One of these systems is selected using the ink/cleaning liquid pumping pressure switching valve 35 according to a target operation.

That is, when the system for pumping ink is selected, the inert gas g output from the mist separator 32 is supplied to the ink pumping pressure control valve 33 so as to suitably control the pumping pressure. The inert gas g then passes through the residual pressure exhaust valve 34 (provided in the ink pumping system), the ink/cleaning liquid pumping pressure switching valve 35, and the air filter 36. After that, the pressure for supplying the ink is checked by the inert gas pressure measurement sensor 37, and the inert gas g is then drawn into the ink pumping tank 38.

On the other hand, when the system for pumping the cleaning liquid is selected, the inert gas g output from the mist separator 32 is supplied to the cleaning liquid pumping pressure control valve 39 so as to suitably control the pumping pressure. The inert gas g then passes through the residual pressure exhaust valve 40 (provided in the cleaning liquid pumping system), the ink/cleaning liquid pumping pressure switching valve 35, and the air filter 71. After that, the pressure for supplying the cleaning liquid is checked by the inert gas pressure measurement sensor 72, and the inert gas g is then drawn into the cleaning liquid pumping tank 73. The following flow in this system will be explained below when the wiping unit 70 (corresponding to the head cleaning mechanism of the present invention) is explained.

The ink in the deaerated ink bottle 41 is supplied to the ink pumping tank 38 by the pump 42 (provided for ink pumping), and the presence or absence of ink in the ink pumping tank 38 is determined by load detection using the ink presence/absence detection load sensor 45. Therefore, when the amount of ink remaining in the ink pumping tank 38 is reduced below a specific amount, this state is detected by the ink presence/absence detection load sensor 45, thereby activating the pump 42 for ink pumping. Accordingly, ink is supplied until the tank is filled with a specific amount of ink. Here, reference numeral 43 indicates an air filter attached to the deaerated ink bottle 41 and reference numeral 44 indicates a tank pressure discharge valve.

When the inert gas g is supplied to the ink pumping tank 38, the inner pressure in the tank is increased, so that the liquid level is lowered, thereby pushing out ink. The pressure of the ink is measured by the liquid pumping pressure measurement sensor 46. The ink then passes through the liquid pumping ON/OFF switching valve 47 and is further pumped and drawn into the sub tank 48. Here, reference numeral 49 indicates a grounding joint which is inserted in the relevant passage and is provided for discharging static electricity.

The sub tank 48 has an air filter 50, a sub tank upper-limit detection sensor 51, and an ink liquid level control detection sensor 52. The sub tank upper-limit detection sensor 51 is provided for stopping the supply of ink to the sub tank 48 when the liquid level in the sub tank 48 exceeds a specific level. The ink liquid level control detection sensor 52 is provided for adjusting the value "head" (see FIG. 5) to be within a predetermined range (e.g., 25 mm±0.5 mm), where the value "head" is measured from each nozzle face 53*a* of a plurality of inkjet heads 53 (refer to FIG. 6) to the liquid level of the ink in the sub tank 48. Here, FIG. 5 shows only one of the inkjet heads 53 for convenience of explanations.

The ink supplied from the sub tank 48 is supplied via the bubble removing valve 54 (provided for the head) to the inkjet head 53. Here, reference numeral 55 indicates a grounding joint which is inserted in the relevant passage and is provided for discharging static electricity.

The bubble removing valve 54 is provided for quickly removing bubbles in the inkjet head 53 by closing the upstream passage of the inkjet head 53 so as to increase the flow rate in suction of the ink included in the inkjet head 53 by using the cap unit (explained below).

Below, each inkjet head 53 will be explained in detail with referring to FIGS. 8 to 12B.

Figure 8:
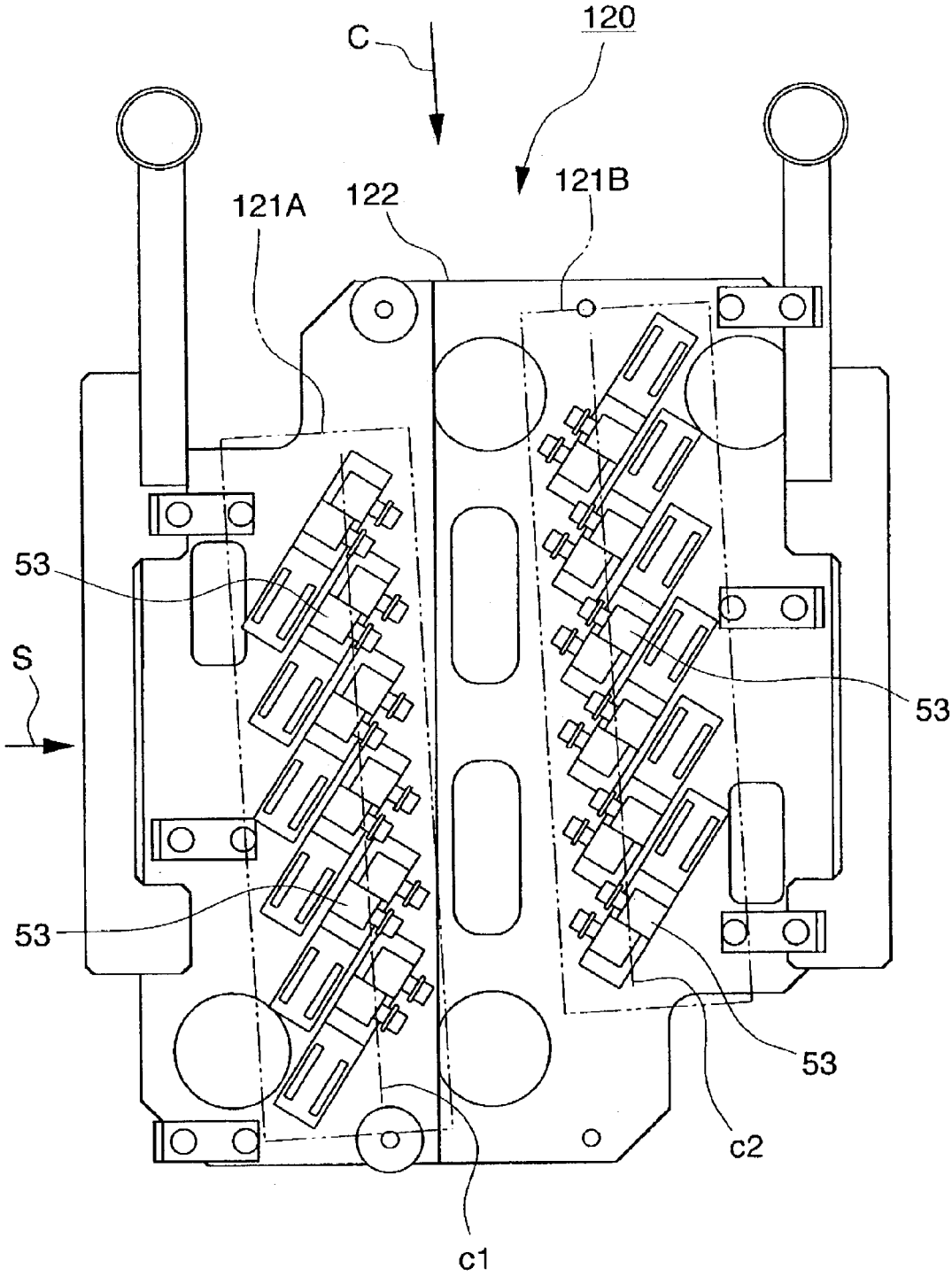
FIG. 8 is a plan view showing the head unit of the inkjet device.
Figure 9:
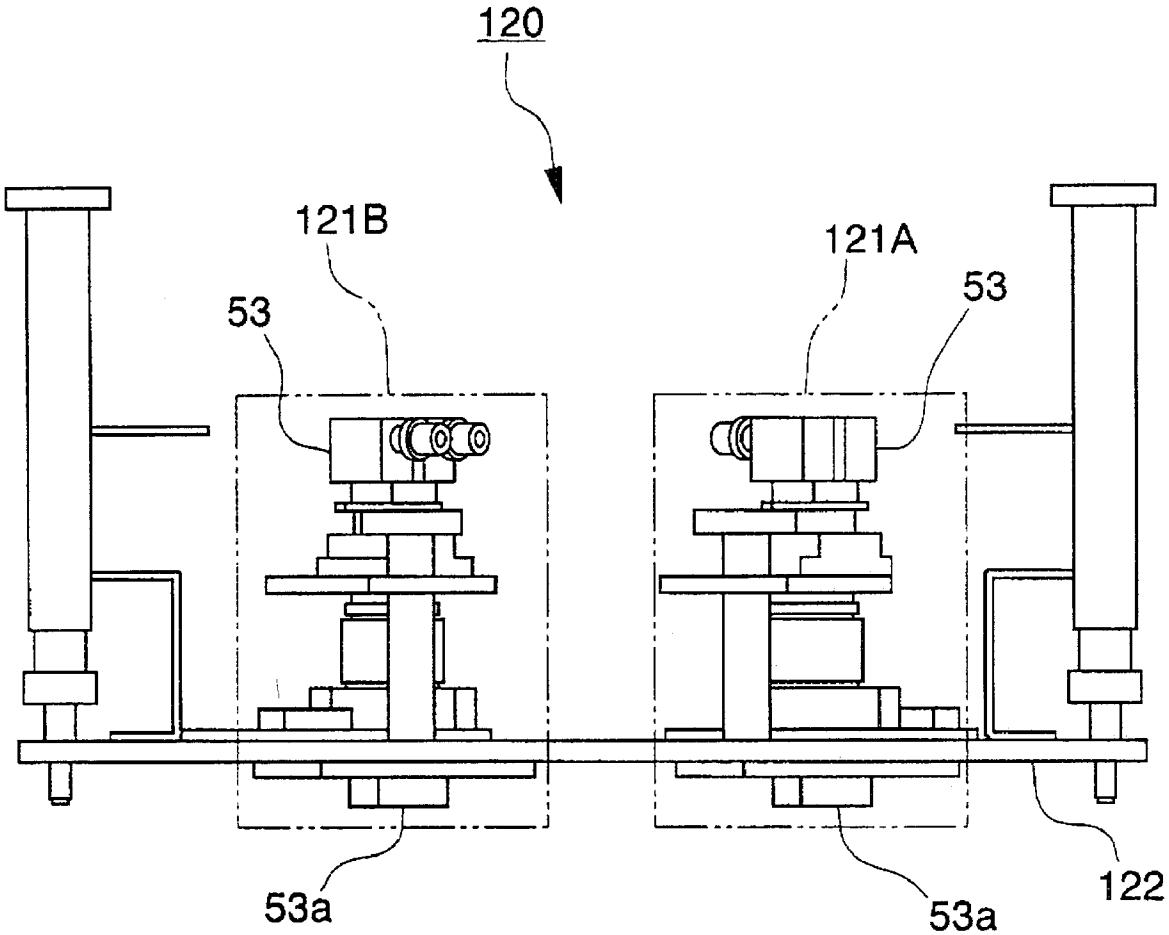
FIG. 9 is a side view of the head unit, which is viewed along arrow C in FIG. 8.
Figure 10A:
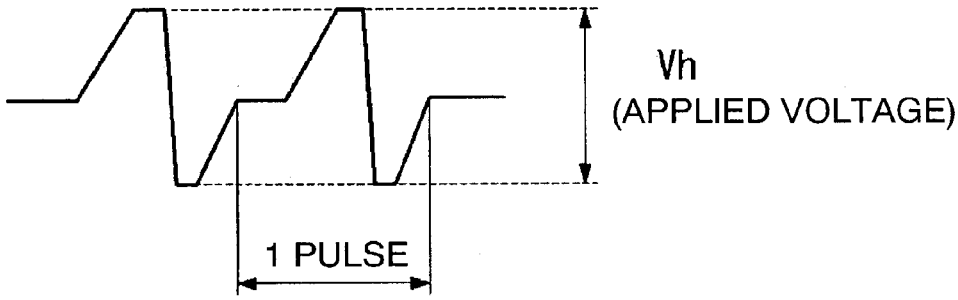
FIGS. 10A to 10D are diagrams for explaining the ink jetting mechanism of the inkjet head provided in the head unit.
Figure 10B:
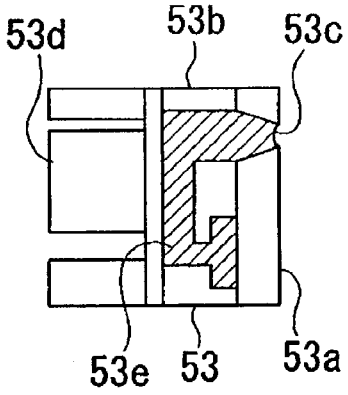
Figure 10C:
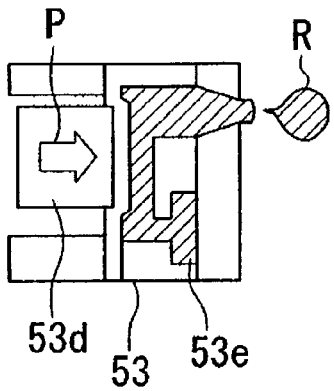
Figure 10D:
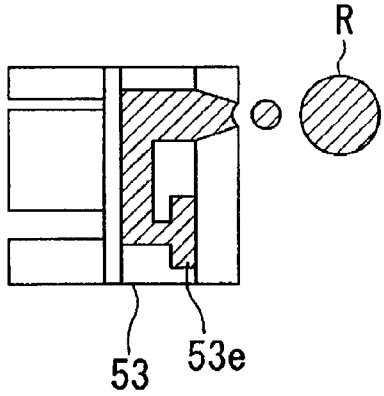
Figure 11A:
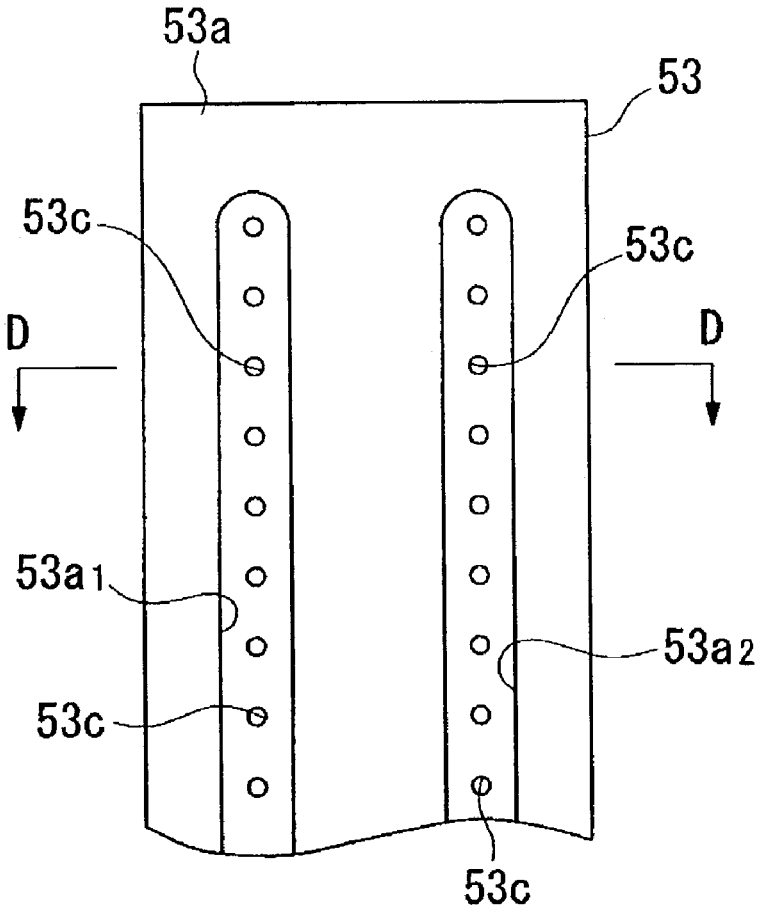
FIGS. 11A and 11B are diagrams showing a portion of the inkjet head, where
Figure 11B:
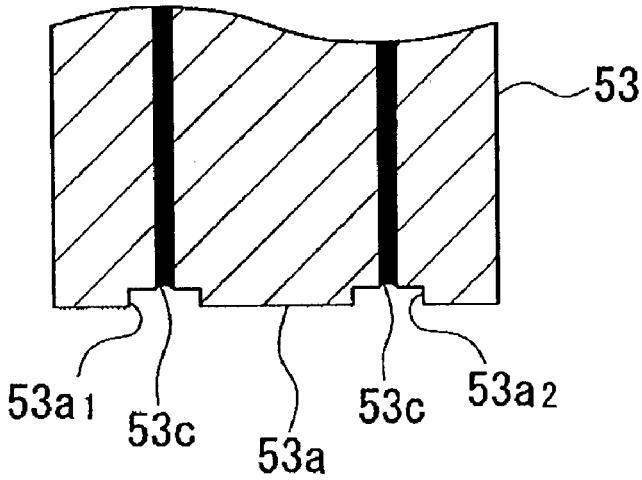
Figure 12A:
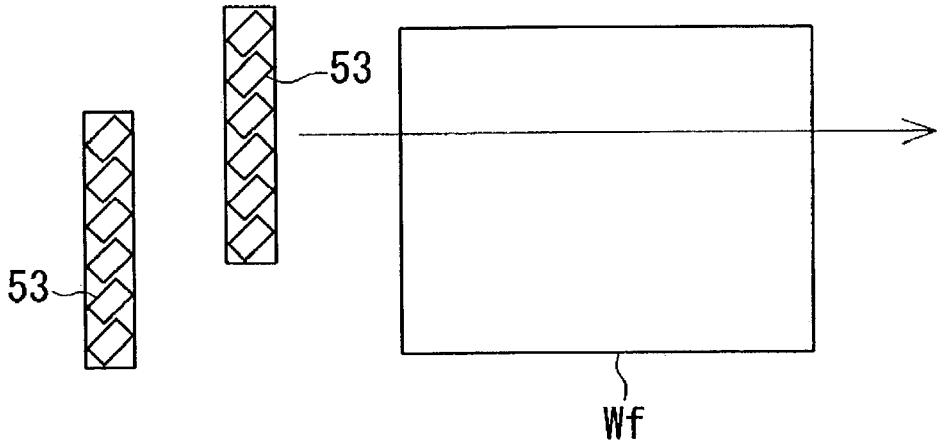
FIGS. 12A and 12B are diagrams for explaining the inkjet head, where
Figure 12B:
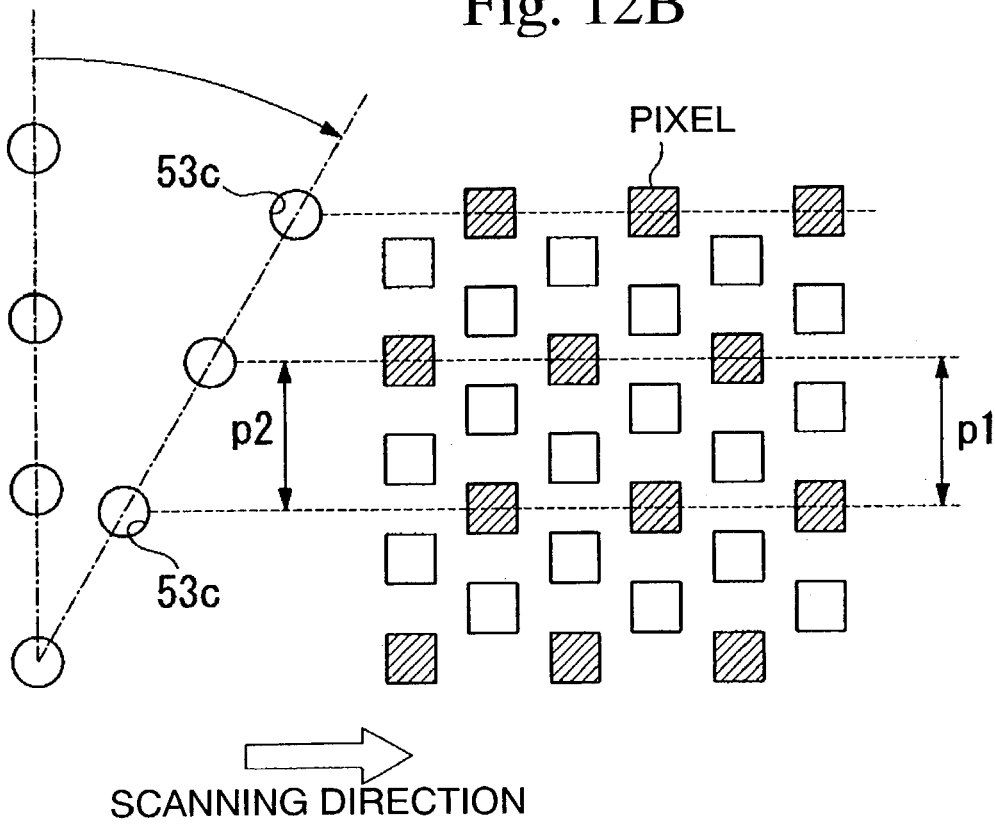

FIG. 8 is a plan view showing the head unit of the inkjet device. FIG. 9 is a side view of the head unit, which is viewed along arrow C in FIG. 8. FIGS. 10A to 10D are diagrams for explaining the ink jetting mechanism of the inkjet head provided in the head unit. FIGS. 11A and 11B are diagrams showing a portion of the inkjet head, where FIG. 11A is a diagram viewed from the side opposite to the nozzle face, and FIG. 11B is a sectional view along line D—D in FIG. 11A. FIGS. 12A and 12B are diagrams for explaining the inkjet head, where FIG. 12A is a diagram for explaining the scanning direction, and FIG. 12B is a diagram for explaining a change in the pitch between the nozzles.

As shown in FIGS. 8 and 9, the inkjet heads 53 of the present embodiment are arranged in a manner such that a first head row consisting of six inkjet heads and a second head row consisting of six inkjet heads are attached to a head holding plate 122 so as to form a head unit 120, where six inkjet heads in each row are inclined so as to partially overlap each other. The first and second head rows are in parallel to each other, and each of the axes c1 and c2 of the rows intersects the direction (see arrow S in FIG. 8) in which a wiping sheet 75 (explained below) is fed.

Each inkjet head 53 can be realized using piezo elements (i.e., piezoelectric elements), and a plurality of nozzles 53*c* are formed in the nozzle face 53*a* of the head body 53*b*. A piezo element 53*d* is provided for each of the nozzles 53*c* (see FIG. 10B).

The piezo element 53*d* is positioned in consideration of the positions of the nozzle 53*c* and the ink chamber 53*e*. When the voltage Vh is applied to the piezo element 53*d* (see FIG. 10A), the piezo element 53*d* slides towards the direction indicated by arrow P (see FIG. 10C) so that the ink chamber 53*e* is pressurized and a specific amount of ink droplet R is jetted from the corresponding nozzle 53*c* (see FIG. 10D). Here, the action of jetting the ink droplet is realized by one pulse in the signal of the applied voltage Vh.

As shown in FIGS. 11A and 11B, in the nozzle face 53*a* of each inkjet head 53, a plurality of grooves 53*a*1 and 53*a*2 (i.e., two grooves in the present embodiment) are provided in parallel to each other, and the nozzles 53*c* are provided at a fixed pitch in each of the grooves 53*a*1 and 53*a*2.

As explained above, the inkjet heads 53 are arranged in a manner such that they are inclined so as to partially overlap each other. Here, the ink droplets R are jetted while the inkjet heads 53 pass over the wafer Wf, that is, the wafer Wf is scanned by the inkjet heads 53 (see FIG. 12A). The above arrangement of the inkjet heads is employed because if each inkjet head 53 is suitably inclined with respect to the scanning direction (i.e., the direction in which the inkjet heads 53 advance), an apparent interval p2 of the nozzles 53*c* can coincide with the pitch p1 between the pixels on the color filter substrate to be manufactured (see FIG. 12B).

Cap Unit 60

Below, the cap unit 60 will be explained. In the cap unit 60 shown in FIG. 5, a plurality of caps 61 (refer to FIGS. 6 and 7 which show the arrangement of the caps) are respectively pushed against the nozzle faces 53*a* of the inkjet heads 53, so that the waste ink can be drawn into the waste ink tank 65 by using the ink suction pump 62. Here, reference numeral 63 indicates a valve positioned in the vicinity of each cap 61, where the valve is provided for reducing operation time in the suction of ink from each inkjet head 53, so as to balance the pressure between the inkjet head 53 and the suction side, that is, to establish the atmospheric pressure. Reference numeral 64 indicates an ink suction pressure detection sensor for detecting an abnormal suction state.

A waste ink tank upper-limit detection sensor 66 is attached to the waste ink tank 65. Accordingly, when it is detected by using this sensor that the liquid level of the waste ink tank 65 exceeds a predetermined level, the waste ink pump 67 can be operated so as to transfer the waste ink to the waste ink bottle 68.

In addition, according to the cap unit 60, (i) before the starting of jetting of ink droplet R from each inkjet head 53, a negative pressure can be applied to the nozzle of the inkjet head 53 so that the ink reaches the nozzle face 53*a*, (ii) a negative pressure can be applied to the nozzle of each inkjet head 53 so as to solve the nozzle clogging, or (iii) the nozzle face 53*a* can be covered by the cap 61 so as to prevent the ink in each nozzle from being dried and to suitably moisturize the nozzle while the manufacturing is not performed (i.e., in the standby state).

Wiping Unit 70

Below, the wiping unit 70 (corresponding to the head cleaning mechanism of the present invention) will be explained with reference to FIG. 5 and FIGS. 13 to 18B.

Figure 13:
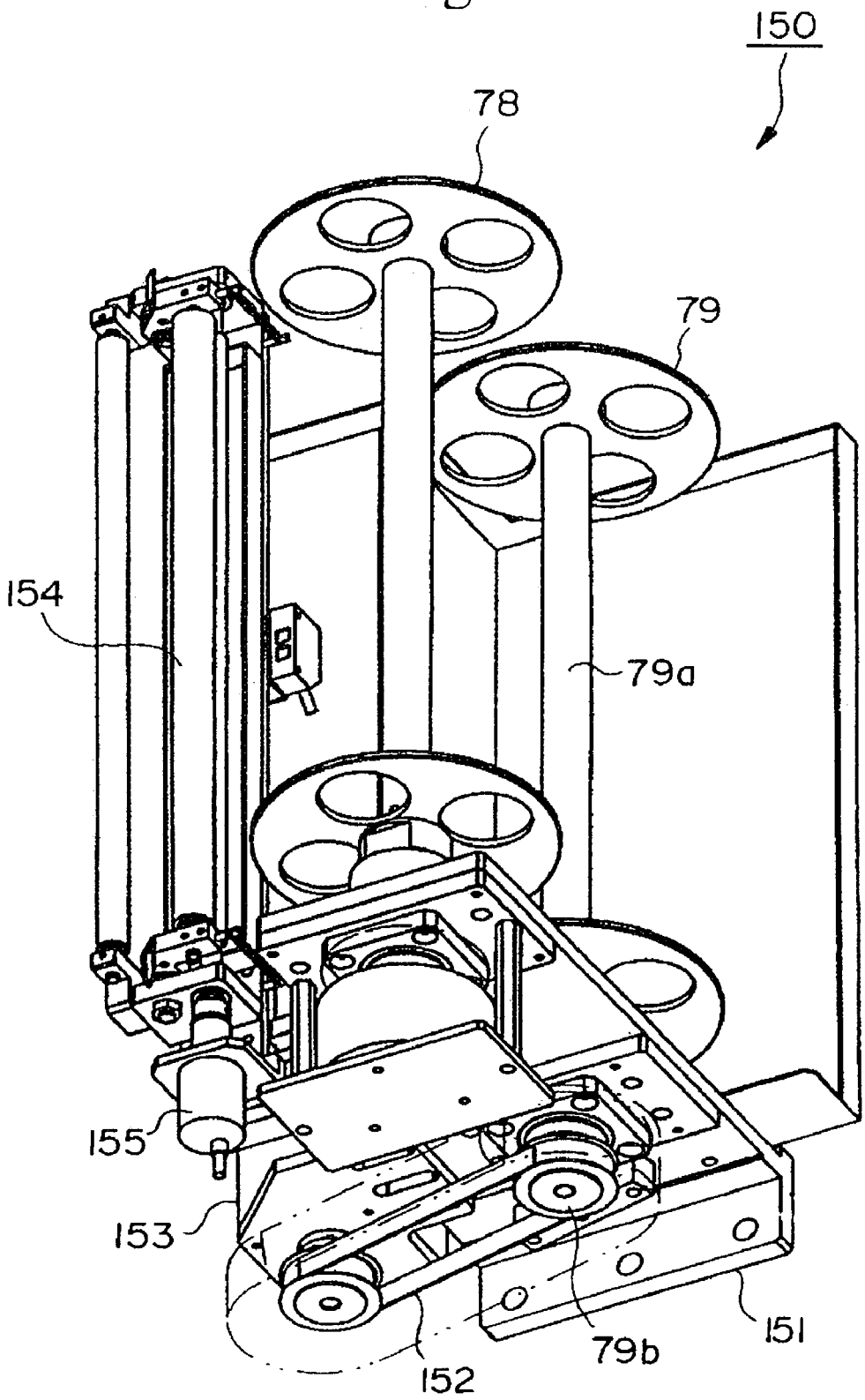
FIG. 13 is a perspective view showing the wiping sheet supply unit of the wiping unit.
Figure 14:
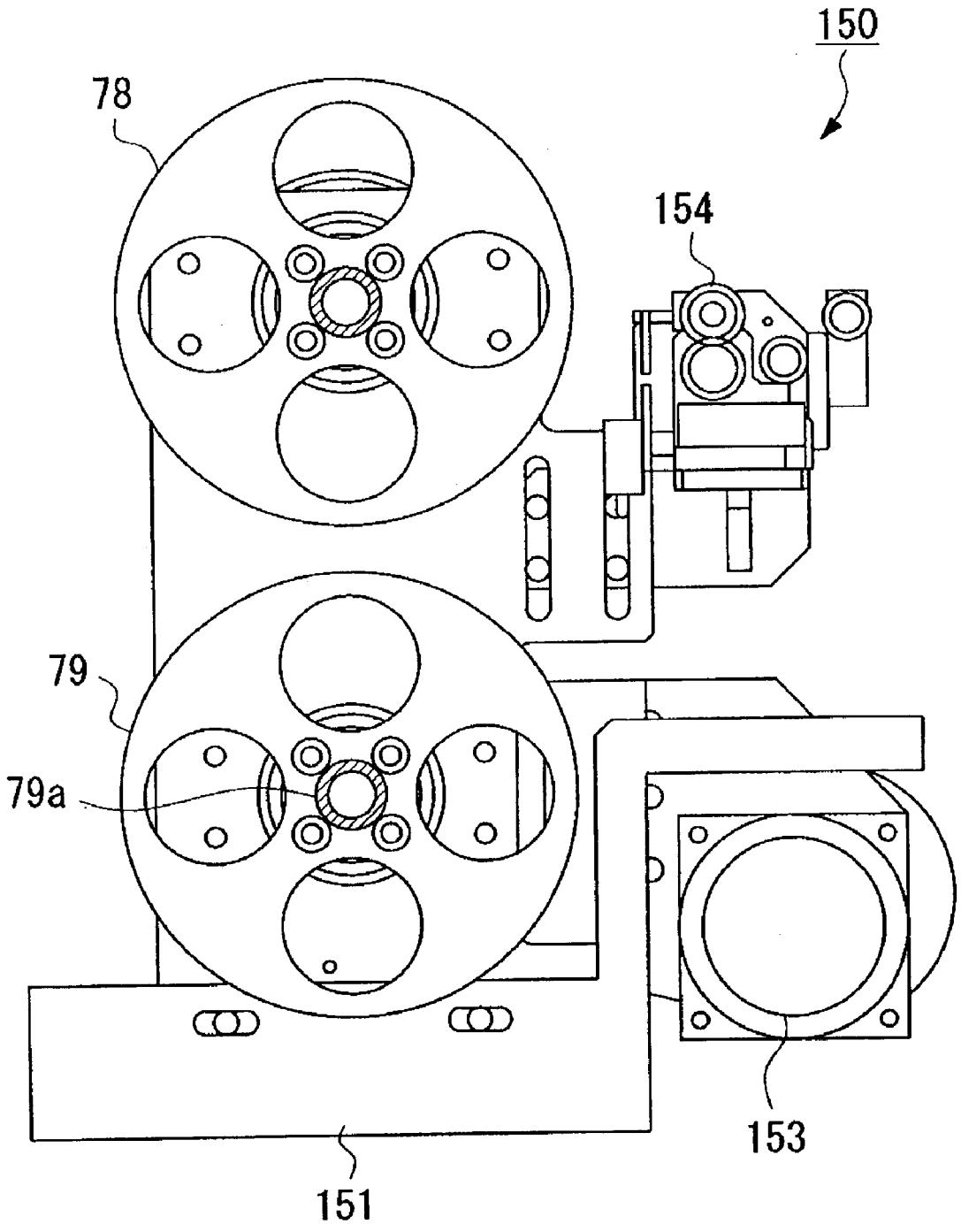
FIG. 14 is a longitudinal sectional view showing the wiping sheet supply unit, which is viewed from a section perpendicular to the axes of the unwinding roller and the winding roller.
Figure 15:
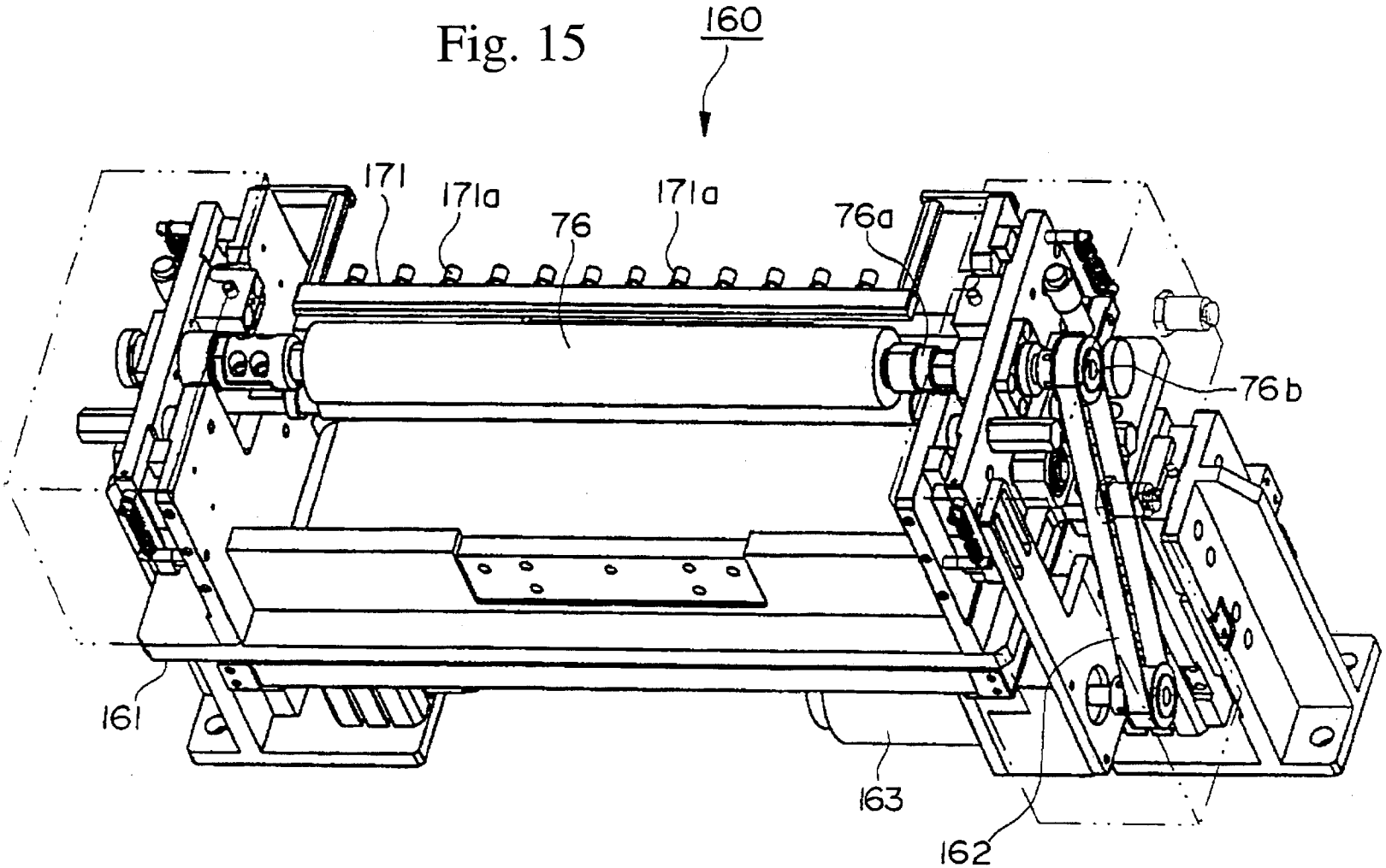
FIG. 15 is a perspective view showing the roller unit of the wiping unit.
Figure 16:
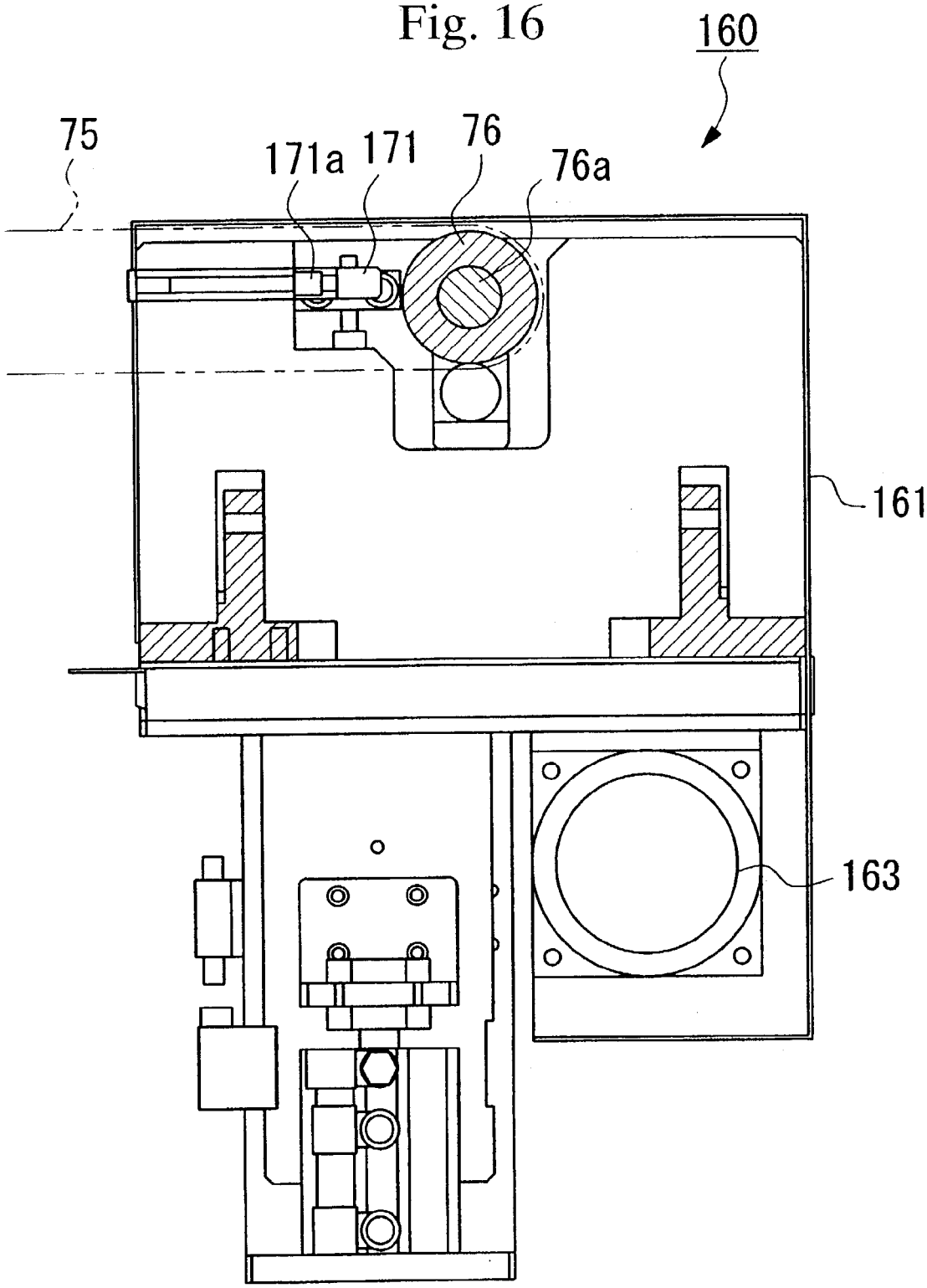
FIG. 16 is a longitudinal sectional view showing the roller unit, which is viewed from a section perpendicular to the axis of the roller in the unit.
Figure 17:
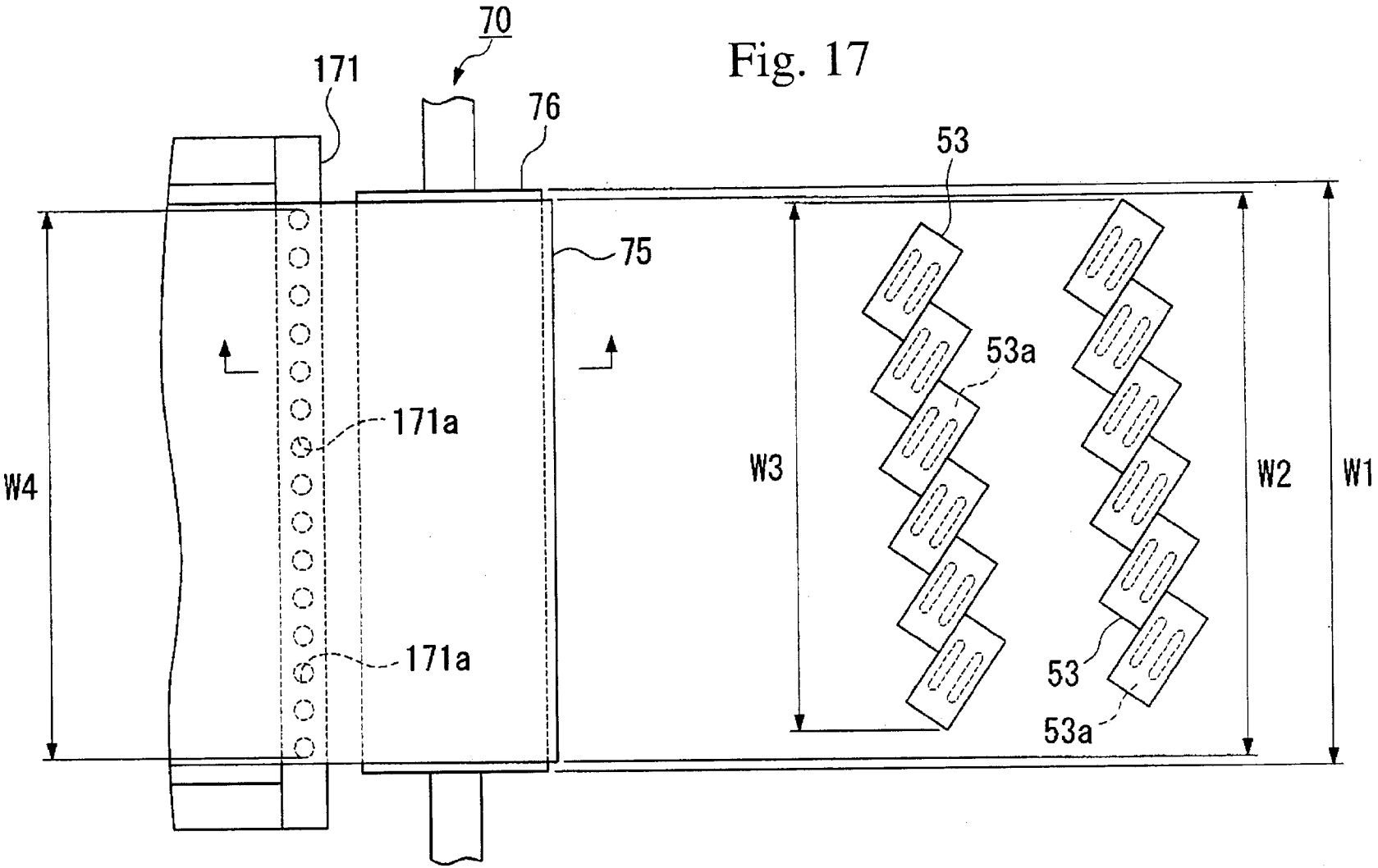
FIG. 17 is a plan view for explaining the cleaning operation for each nozzle face by using the wiping unit.
Figure 18B:
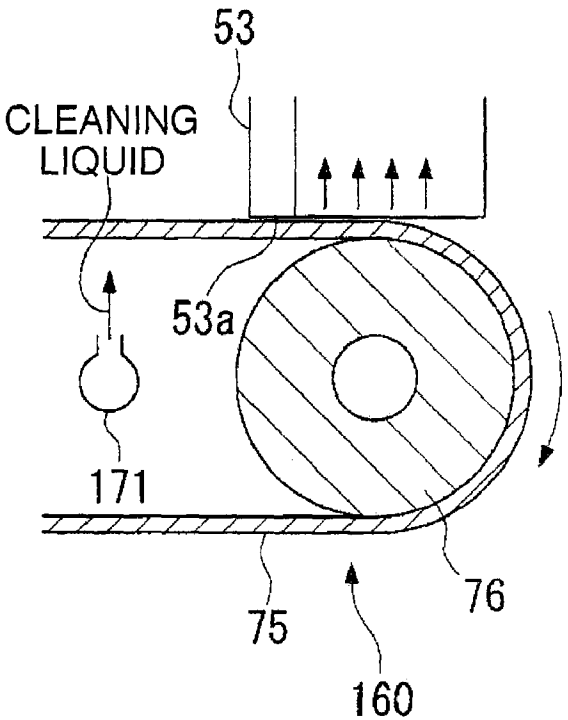
FIGS. 18A and 18B are side views for explaining the cleaning operation for each nozzle face by using the wiping unit, where
Figure 18A:
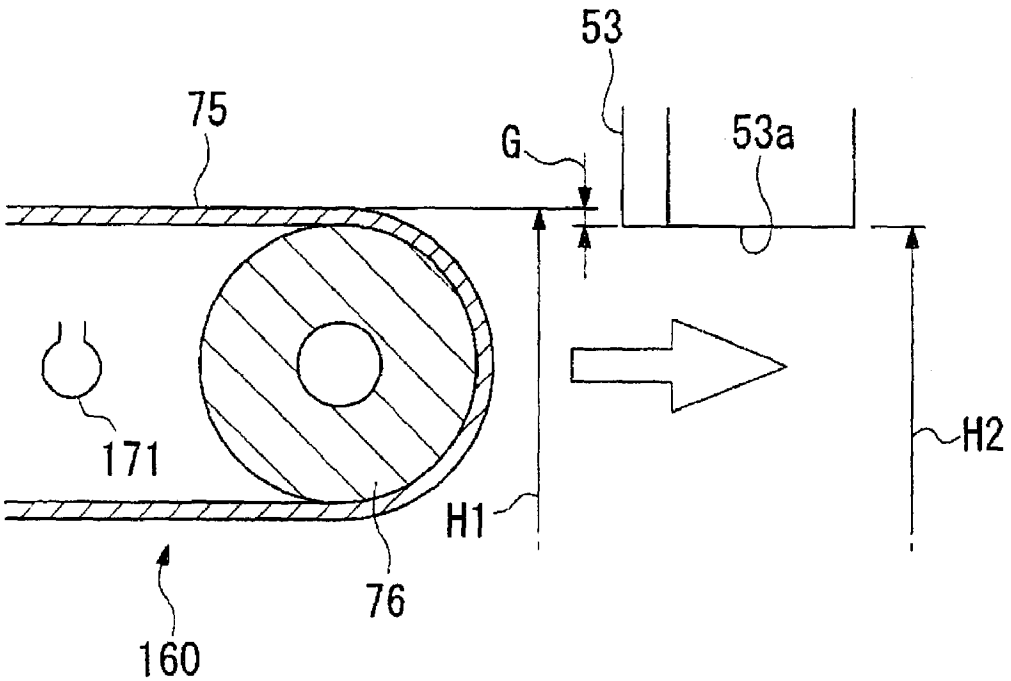

FIG. 13 is a perspective view showing the wiping sheet supply unit of the wiping unit 70. FIG. 14 is a longitudinal sectional view showing the wiping sheet supply unit, which is viewed from a section perpendicular to the axes of the unwinding roller and the winding roller. FIG. 15 is a perspective view showing the roller unit of the wiping unit 70. FIG. 16 is a longitudinal sectional view showing the roller unit, which is viewed from a section perpendicular to the axis of the roller in the unit. FIG. 17 is a plan view for explaining the cleaning operation for each nozzle face by using the wiping unit 70. FIGS. 18A and 18B are side views for explaining the cleaning operation for each nozzle face by using the wiping unit 70, where FIG. 18A shows the state before the wiping sheet is pressed against the nozzle face, and FIG. 18B shows the state in which the wiping sheet is pressed against the nozzle face.

The wiping unit 70 is used for collectively cleaning the nozzle faces 53*a* of the inkjet heads 53 (i.e., for cleaning the nozzle faces together) regularly or at any time. As shown in FIG. 5, the wiping unit 70 comprises a wiping sheet 75 for wiping the nozzle faces 53*a*, a roller 76 for pressing the wiping sheet 75 against the nozzle faces 53*a*, a cleaning liquid supply unit 77 for jetting cleaning liquid towards the wiping sheet 75, an unwinding roller 78 for unwinding and supplying the wiping sheet 75 to the nozzle faces 53*a*, and a winding roller 79 for winding the wiping sheet 75 after wiping the nozzle faces 53*a*, and an electric motor 153 for driving and rotating the winding roller 79. As a preferable example, the wiping sheet 75 is a 100% polyester fabric. The roller 76 is made of rubber and has elasticity against the pressing force which is applied to the peripheral face of the roller.

According to the wiping unit 70, the wiping sheet 75 unwound by the unwinding roller 78 is pressed against each nozzle face 53*a* by using the roller 76 while the wiping sheet 75 is fed towards the nozzle faces 53*a*, so that an unused cleaning face can always be supplied to each nozzle face 53*a*. In addition, the wiping sheet 75 is pressed against the nozzle faces 53*a* by the pressing force using the roller 76; thus, the wiping face of the wiping sheet can be reliably applied to each nozzle face 53*a*.

When the specification of the color filter substrate to be manufactured is changed, the measurements such as the pitch between the inkjet heads 53 should be changed. In such a situation, if a dedicated wiping unit for each inkjet head 53 is provided so as to clean the nozzle face 53*a* of the head, the arrangement of the wiping units should also be changed in accordance with a change in the pitch between the inkjet heads 53, and the like. However, the wiping unit 70 of the present embodiment has a structure for collectively cleaning the nozzle faces 53*a* using a single unit; therefore, the wiping unit 70 is not affected by such a change in the pitch between the inkjet heads 53, or the like.

As shown in FIGS. 13 and 14, the unwinding roller 78 and the winding roller 79 are fastened to the roller casing 151 in a manner such that each roller is rotatable around its axis. According to the rotation of the driven winding roller 79, the wiping sheet 75 (not shown in FIGS. 13 and 14) can be unwound from the unwinding roller 78. Here, the driving of rotation of the winding roller 79 is performed by driving the pulley 79*b* via the belt 152 by using the electric motor 153, where the pulley 79*b* is coaxially attached to an end of the rotation shaft 79*a* of the winding roller 79.

The guide roller 154 is provided for accurately guiding the feeding of the wiping sheet 75. The rotation speed of the guide roller 154 is measured using the tachometer (or encoder) 155 attached to an end of the guide roller 154, thereby measuring the feeding speed of the wiping sheet 75.

The above-explained unwinding roller 78, winding roller 79, roller casing 151, wiping sheet 75, electric motor 153, guide roller 154, and tachometer (or encoder) 155 construct the wiping sheet supply unit 150.

As shown in FIGS. 15 and 16, the roller 76 is fastened to the roller casing 161 in a manner such that the roller is rotatable around its axis, and the rotation of the roller 76 is driven in synchrony with the feeding speed of the wiping sheet 75 which is fed from the wiping sheet supply unit 150. Here, the driving of rotation of the roller 76 is performed by driving the pulley 76*b* via the belt 162 by using the electric motor 163, where the pulley 76*b* is coaxially attached to an end of the rotation shaft 76*a* of the roller 76.

The nozzle unit 171 of the cleaning liquid supply unit 77 is fixedly positioned adjacent to the roller 76. This nozzle unit 171 has a tube of substantially rectangular cross section, which is parallel to the axis of the roller 76 and on which a plurality of nozzle openings 171*a* are provided. The nozzle openings 171*a* are directed upwards and a suitable amount of cleaning liquid can be jetted from the nozzle openings 171*a* towards the wiping sheet 75 (from the back face side). Accordingly, the cleaning face of the wiping sheet 75 can be moistened immediately before the nozzle faces 53*a* are wiped by the cleaning face.

The reason for moistening the wiping sheet 75 in advance by using the cleaning liquid supply unit 77 is of course to much more cleanly wipe the nozzle faces 53*a* owing to the cleaning effect by the cleaning liquid. However, another reason will be explained below. If a dried wiping sheet 75 is pressed against the nozzle faces 53*a* (i.e., in the dry wiping system), the ink in each inkjet head 53 may be excessively attracted towards the nozzle face 53*a* due to the absorbency of the wiping sheet 75. However, in the present embodiment in which the cleaning face of the wiping sheet 75 is moistened in advance by using the cleaning liquid supplied from the cleaning liquid supply unit 77 (i.e., in the wet wiping system), it is possible to prevent an excessive amount of ink from being drawn from the inkjet head 53 and to reliably remove the remaining ink adhered to each nozzle face 53*a*.

The above-explained roller 76, roller casing 161, electric motor 163, and cleaning liquid supply unit 77 construct the roller unit 160. As shown in FIG. 6, the wiping unit 70 which has the roller unit 160 is fastened to a common stage 200 (i.e., attached to the stage 200 together with the roller unit 160), and the wiping unit 70 on the stage 200 can move relatively to the stage 201 in the direction from left to right (or from right to left) on the paper surface of FIG. 6.

As shown in FIG. 17, the width W1 of the roller 76 and the width W2 of the wiping sheet 75 are each equal to or greater than the width W3 which is formed by all partially-overlapped nozzle faces 53*a*. Similarly, the width W4 formed by all nozzle openings 171*a* of the nozzle unit 171 (i.e., the length of the line produced by the aligned nozzle openings 171*a*) is greater than the above width W3. Here, in FIG. 17, the nozzle openings 171*a* are conveniently indicated on the pipe of the nozzle unit 171 and the positions of the nozzle openings 171*a* do not completely correspond to those shown in FIGS. 15 and 16.

According to this structure, all nozzle faces 53*a* are present within (i) the area of the cleaning face of the wiping sheet 75, (ii) the area onto which the roller 76 is pushed, and (iii) the area in which the cleaning liquid is supplied from the nozzle unit 171; thus, all nozzle faces 53*a* can be reliably wiped.

The pushing force of the wiping sheet 75 onto each nozzle face 53*a* is predetermined to be within the range from 100 to 1000 gf. This is because a suitably-controlled (or maintained) pushing force can solve some possible problems, for example, can prevent the nozzle faces 53*a* from being damaged by pushing the wiping sheet 75 with an excessive force, or can prevent the ink adhered to the nozzle faces 53*a* from being incompletely removed from the nozzle face by pushing the wiping sheet 75 with insufficient force.

More specifically, if the predetermined pushing force is lower than 100 gf, the ink adhered to the nozzle faces 53*a* may not be completely removed due to insufficient pushing force. On the other hand, if the predetermined pushing force is higher than 1000 gf, the nozzle faces 53*a* may be damaged by the excessive force; thus, the predetermined pushing force is defined to be from 100 to 1000 gf. More preferably, the predetermined pushing force is suitably defined according to the material of the wiping sheet 75 and the hardness of the roller 76. If the wiping sheet 75 is a polyester fabric and the roller 76 is made of rubber having a hardness (IRHD) of 20 to 70, the predetermined pushing force is preferably within 200 to 400 gf.

The pushing force can be set by directly measuring the pushing force. However, in the present embodiment, as shown in FIGS. 18A and 18B, the pushing force is set in a manner such that the displacement (i.e., the amount of compression) of the wiping sheet 75 and the roller 76, which corresponds to the amount of pushing (towards wiping sheet 75 and the roller 76) by the nozzle face 53*a*, measures a predetermined value. More specifically, a suitable range for the above displacement is predetermined according to the material or thickness of the wiping sheet 75 or the hardness of the roller 76. For example, if the wiping sheet 75 is a sheet which has a thickness of 0.6 mm and is made of polyester fabric, and the roller 76 is made of rubber having a hardness (IRHD) of 30 to 60, then the displacement between (i) the rotation axis of the roller 76 when the nozzle face 53*a*, the wiping sheet 75, and the roller 76 contact each other (i.e., during the pushing of the roller onto the nozzle face) and (ii) the rotation shaft of the roller 76 after the pushing of the roller is set to be in a range from 0.1 to 1 mm.

That is, before the pushing using the roller (see FIG. 18A), the roller unit 160 is positioned away from each inkjet head 53, and the height (in the vertical direction) of the upper face (i.e., cleaning face) of the wiping sheet 75 in this state is defined as H1. On the other hand, the height (in the vertical direction) of the nozzle face 53*a* of each inkjet head 53 is defined as H2. Here, it is defined that H2−H1 is 0.1 to 1 mm.

Accordingly, as shown in FIG. 18B, when the roller 76 of the roller unit 160 is horizontally moved using a roller unit driving mechanism (not shown) so as to position the roller 76 immediately under the nozzle unit 120 and perform the head cleaning, the wiping sheet 75 and the roller 76 are pushed downwards by the nozzle faces 53*a* of the relevant inkjet heads 53 (which are fastened in a fixed position) and are deformed. Here, the amount of deformation (i.e., displacement) G is predetermined to be in a range from 0.1 to 1 mm.

If the displacement G is less than 0.1 mm, it can be determined that the pushing force via the wiping sheet 75 is insufficient, and conversely, if the displacement G exceeds 1 mm, it can be determined that the pushing force via the wiping sheet 75 is excessive. Therefore, the displacement G is set within the range from 0.1 to 1 mm, so that the pushing force via the wiping sheet 75 can be easily set to be in a predetermined range without directly measuring the pushing force applied onto each nozzle face 53*a*.

Weight Measurement Unit 90

Below, the weight measurement unit 90 will be explained with referring to FIG. 7. This weight measurement unit 90 is provided for measuring and controlling the weight of an ink droplet R jetted from the nozzle of each inkjet head 53. In order to measure the weight, 2000 droplets R are received from each inkjet head 53, and the accurate weight per droplet is calculated by measuring the weight of the 2000 droplets and dividing the measured weight by 2000. The result of the weight measurement of the ink droplet R is used for optimally controlling the size of ink droplet R jetted from each inkjet head 53.

Dot Drop Detection Unit 100

Below, the dot drop detection unit 100 will be explained.

The dot drop detection unit 100 as shown in FIG. 7 is provided for checking the nozzle clogging of each inkjet head 53. In the test, each inkjet head 53 is moved above the dot drop detection unit 100, and an ink droplet is jetted from the inkjet head 53 in a manner such that the ink droplet interrupts a laser beam emitted from a laser source (not shown). If jetting of an ink droplet is commanded but the laser beam is not interrupted, then it is determined that ink is not jetted due to nozzle clogging and thus dot dropout (i.e., absence of any dot) may occur in the manufactured product. In such a case, suction using the cap unit 60 through the nozzle of the inkjet head 53 is performed, thereby solving the nozzle clogging.

The inkjet devices 3, 7, and 11 and the related head cleaning method of the present embodiment employ the wiping unit 70 for collectively cleaning the nozzle faces 53*a* of the inkjet heads 53. Accordingly, even if the pitch between the inkjet heads 53 or the like is changed so as to cope with changes in specification for the color filter substrate to be manufactured (e.g., a change in the size of the substrate), the nozzle faces 53*a* can be sufficiently cleaned without considerably changing the structure of the wiping unit 70. Therefore, the nozzle faces 53*a* can be reliably cleaned while flexibly coping with any change in specification for the color filter substrate to be manufactured.

The inkjet devices 3, 7, and 11 and the related head cleaning method of the present embodiment also employ the wiping unit 70 which includes the wiping sheet 75 for wiping the nozzle faces 53*a*, and the roller 76 for pushing the wiping sheet 75 against the nozzle faces 53*a*. Accordingly, an unused cleaning face of the wiping sheet 75 can always be supplied to the nozzle faces 53*a*; thus, no remaining ink is present on each nozzle face 53*a* after cleaning and the nozzle faces 53*a* can be reliably cleaned.

In the inkjet devices 3, 7, and 11 of the present embodiment, the widths of the wiping sheet 75 and the roller 76 are each equal to or greater than the total width of the arranged nozzle faces 53*a*, where the total width is measured in the direction parallel to the widths of the wiping sheet 75 and the roller 76. Accordingly, all nozzle faces 53*a* are covered with the cleaning face of the wiping sheet 75; thus, all nozzle faces 53*a* can be completely cleaned.

The inkjet devices 3, 7, and 11 and the related head cleaning method of the present embodiment also employ the wiping unit 70 which further comprises the cleaning liquid supply unit 77 for supplying cleaning liquid to the wiping sheet 75. Accordingly, the ink adhered to each nozzle face 53*a* can be reliably removed without attracting excessive ink from the inside of each inkjet head 53.

In the inkjet devices 3, 7, and 11 and the related head cleaning method of the present embodiment, the pushing force of the wiping sheet 75 onto each nozzle face is set to a predetermined pressure. Accordingly, the pushing force is defined in advance to a suitable value, thereby preventing damage to the nozzle faces and also preventing ink (which has adhered to each nozzle face) from remaining on the nozzle face.

Also in the inkjet devices 3, 7, and 11 and the related head cleaning method of the present embodiment, the above predetermined pushing force is within the range from 100 to 1000 gf. Accordingly, damage to the nozzle faces and remaining of ink adhering to each nozzle face can be reliably prevented.

Also in the inkjet devices 3, 7, and 11 and the related head cleaning method of the present embodiment, the above predetermined pushing force is set in a manner such that when the roller 76 is pushed via the wiping sheet 75 onto the nozzle faces 53*a*, the amount of compression of the wiping sheet and the roller, that is, the displacement G is a predetermined value. Accordingly, the pushing force of the wiping sheet 75 can be easily set to be within the predetermined range without directly measuring the pushing force applied to each nozzle face 53*a*.

Also in the inkjet devices 3, 7, and 11 and the related head cleaning method of the present embodiment, the above predetermined value is from 0.1 to 1 mm. Accordingly, the pushing force of the wiping sheet 75 can be reliably set to be within the predetermined range.

In the device manufacturing system of the present embodiment, devices are manufactured by employing the inkjet devices 3, 7, and 11 and the above-explained head cleaning method. Accordingly, it is possible to flexibly cope with changes in specification for the products and thus to manufacture devices corresponding to various kinds of specifications.

In addition, the devices according to the present embodiment are manufactured using the inkjet devices 3, 7, and 11 and the related head cleaning method. Accordingly, it is possible to flexibly cope with changes in specification for the target products and thus to obtain devices corresponding to various kinds of specifications.

The present invention is not limited to the above-explained embodiment, and various changes are possible within the spirit and the scope of the present invention. For example, in the above-explained embodiment, the R (red) pattern is formed first, then the G (green) pattern is formed, and finally, the B (blue) pattern is formed. However, the order of forming the patterns is not limited and another order may be employed where necessary.

The device manufacturing system of the present invention is not limitedly used for manufacturing the color filter (substrate) for liquid crystal devices and may be used for manufacturing EL (electroluminescent) display devices. The EL display device has a structure in which a thin film which includes fluorescent inorganic and organic compounds is placed between a cathode and an anode. In this structure, excitons are produced by injecting electrons and holes into the thin film so as to recombine the electrons and the holes. When the produced excitons are deactivated, light (i.e., fluorescence or phosphorescence) is emitted, which is used for light emission in the EL display device. Regarding fluorescent materials which can be used for the EL display device, those for producing light of red, green, and blue colors (i.e., materials for forming light-emitting layers) and those for forming layers into which holes are injected and through which electrons are transported may be ink materials, and a desired pattern of each ink material may be formed on a device substrate such as a TFT substrate, thereby producing a self-emitting full-color EL device. The device according to the present invention includes such an EL device.

In an example process for producing such a self-emitting full-color EL device, partition walls for separating each pixel are formed first by using a resin resist (i.e., similar to the black matrix forming process for producing a color filter), and the substrate is subjected to plasma processing, UV processing, coupling, or the like before jetting droplets. Such processing is performed so as to make each droplet, which has been jetted towards the surface of a layer (which functions as a lower layer), easily adhere to the surface, and to prevent the partition wall from repelling the jetted droplet and the repelled droplet from mixing with another droplet in an adjacent section surrounded by the partition walls. After that, first and second film forming processes are performed so as to produce an EL device, where in the first film forming step, droplets are supplied as material for forming a layer for hole injection and electron transportation, and in the second film forming step, an emitting layer is similarly formed.

The produced EL device can be applied to still picture display such as segment display or entire-surface (simultaneous) display, or may be used in simple information fields relating to paintings, characters, and labels. The EL device may also been as a spot, linear, or surface (shaped) light source. In addition, the EL device may be used as a passive driven display device or may be driven by an active element such as TFT. Accordingly, full-color display devices having high brightness and responsibility can be obtained.

If a metal or insulating material is supplied to the film forming apparatus of the present invention, direct fine patterning for forming metal wiring, an insulating film, or the like can be performed, and novel and highly-functional devices can be produced.

In the above-explained embodiment, the names "inkjet device" and "inkjet head" are conveniently used and "ink" is jetted from the head. However, the object jetted from the inkjet head is not limited to the ink droplet and includes any controlled droplet which can be jetted from the head. That is, various kinds of materials can be used such as a material for producing the above-explained EL device, a metal material, an insulating material, and a semiconductor material.

In addition, the above-explained embodiment employs the inkjet head using a piezoelectric element. However, this in not a limiting condition, and it is possible to employ an inkjet head in which air bubbles are generated in a target liquid by using a heating element, and each droplet is jetted via pressure produced by the bubbles.

Furthermore, the inkjet head itself is not a limiting condition, and a dispenser may be used so as to jet a specific number of droplets.

What is claimed is:

1. A head cleaning method for cleaning a plurality of heads for jetting droplets, each head having a nozzle in a nozzle face, the method comprising:

collectively and simultaneously cleaning the nozzle face of each of the plurality of heads by using a head cleaning mechanism, the head cleaning mechanism having a wiping sheet and a roller, the collectively and simultaneously cleaning including moving the roller from a position away from the plurality of heads to a position under the nozzle face of each of the plurality of heads so as to feed the wiping sheet by the roller towards the nozzle face of each of the plurality of heads, and wiping the nozzle faces by pushing the roller onto the nozzle face of each of the plurality of heads such that the wiping sheet is positioned between the roller and the nozzle face of each of the plurality of heads, the plurality of heads for jetting droplets being inkjet heads.

2. A head cleaning method as claimed in claim 1, the collectively and simultaneously cleaning the nozzle face of each of the plurality of heads includes supplying a cleaning liquid to the wiping sheet so as to moisten the wiping sheet before wiping the nozzle face of each of the plurality of heads.

3. A head cleaning method as claimed in claim 1, wherein pushing the roller onto the nozzle face of each of the plurality of heads produces a predetermined pushing force.

4. A head cleaning method as claimed in claim 3, the predetermined pushing force being from 100 to 1000 gf.

5. A head cleaning method as claimed in claim 3, the roller and the wiping sheet deforming when the roller is pushed onto the nozzle face of each of the plurality of heads; and setting the predetermined pushing force so as to obtain a target amount of deformation of the wiping sheet and the roller.

6. A head cleaning method as claimed in claim 5, the target amount of deformation being from 0.1 to 1 mm.

* * * * *